US009334140B2

(12) United States Patent
Watanabe et al.

(10) Patent No.: US 9,334,140 B2
(45) Date of Patent: May 10, 2016

(54) SHEET PROCESSING APPARATUS, IMAGE FORMING SYSTEM, AND SHEET CONVEYING METHOD

(71) Applicants: Takahiro Watanabe, Kanagawa (JP); Tomohiro Furuhashi, Kanagawa (JP); Shuuya Nagasako, Kanagawa (JP); Michitaka Suzuki, Kanagawa (JP); Kyosuke Nakada, Kanagawa (JP); Akira Kunieda, Tokyo (JP); Yuji Suzuki, Kanagawa (JP)

(72) Inventors: Takahiro Watanabe, Kanagawa (JP); Tomohiro Furuhashi, Kanagawa (JP); Shuuya Nagasako, Kanagawa (JP); Michitaka Suzuki, Kanagawa (JP); Kyosuke Nakada, Kanagawa (JP); Akira Kunieda, Tokyo (JP); Yuji Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/284,369

(22) Filed: May 21, 2014

(65) Prior Publication Data

US 2014/0364295 A1 Dec. 11, 2014

(30) Foreign Application Priority Data

Jun. 7, 2013 (JP) ..... 2013120880
Feb. 26, 2014 (JP) ..... 2014035722

(51) Int. Cl.

| | |
|---|---|
| ***B65H 45/04*** | (2006.01) |
| ***B31F 1/00*** | (2006.01) |
| ***B31F 1/10*** | (2006.01) |

(Continued)

(52) U.S. Cl.

CPC ..... *B65H 45/04* (2013.01); *B31F 1/0025* (2013.01); *B31F 1/10* (2013.01); *B65H 45/14* (2013.01); *B65H 45/147* (2013.01); *B65H 45/20* (2013.01); *B65H 2801/03* (2013.01)

(58) Field of Classification Search

CPC ..... B31F 1/10; B31F 1/0025; B65H 45/20; B65H 45/147

USPC ..... 270/32, 39.01; 493/416, 419, 434, 435, 493/421, 440, 442; 271/184

See application file for complete search history.

(56) References Cited

U.S. PATENT DOCUMENTS 6,592,506 B1 * 7/2003 Lyga ..... 493/424
6,648,319 B2 * 11/2003 Chapman ..... 270/45
6,719,680 B2 * 4/2004 Hosoya et al. ..... 493/324

(Continued)

FOREIGN PATENT DOCUMENTS

CN 101054137 A 10/2007
CN 102639419 A 2/2015

(Continued)

OTHER PUBLICATIONS

U.S. Appl. No. 14/070,932, filed Nov. 4, 2013.

*Primary Examiner* — Leslie A Nicholson, III
(74) *Attorney, Agent, or Firm* — Duft Bornsen & Fettig LLP

(57) ABSTRACT

A sheet processing apparatus includes: first to third pairs of conveying members; and a bifurcating claw that moves to a first guiding position for guiding the sheet to the second pair of conveying members, a second guiding position for guiding a deflected portion of the sheet to the third pair of conveying members, and a third guiding position for guiding a leading end of the sheet to the third pair of conveying members. The second pair of conveying members is rotated backward in a state in which the sheet is held by the first pair of conveying members and the second pair of conveying members, to guide the deflected portion to the third pair of conveying members and cause the deflected portion to be folded by the third pair of conveying members.

8 Claims, 15 Drawing Sheets

R1: FIRST PAIR OF CONVEYING ROLLERS
R2+R3: SECOND PAIR OF CONVEYING ROLLERS Rt1
R3+R4: THIRD PAIR OF CONVEYING ROLLERS Rt2
R3+R5: FOURTH PAIR OF CONVEYING ROLLERS Rt3
R6: FIFTH PAIR OF CONVEYING ROLLERS

(51) Int. Cl.
*B65H 45/14* (2006.01)
*B65H 45/20* (2006.01)

(56) References Cited

U.S. PATENT DOCUMENTS

| | | | | |
|---|---|---|---|---|
| 7,052,005 | B2 * | 5/2006 | Yamakawa et al. | 270/37 |
| 7,694,966 | B2 | 4/2010 | Nagasako et al. | |
| 7,918,453 | B2 * | 4/2011 | Duff et al. | 271/272 |
| 8,256,757 | B2 * | 9/2012 | Imazu et al. | 270/32 |
| 8,264,399 | B2 | 9/2012 | Shinomiya et al. | |
| 8,267,399 | B2 | 9/2012 | Kushida et al. | |
| 8,496,249 | B2 * | 7/2013 | Dowling et al. | 271/303 |
| 8,616,547 | B2 | 12/2013 | Kushida et al. | |
| 2007/0238596 | A1 | 10/2007 | Terhaag et al. | |
| 2009/0062100 | A1 | 3/2009 | Takekawa et al. | |
| 2009/0129840 | A1 | 5/2009 | Takekawa et al. | |
| 2010/0213661 | A1 * | 8/2010 | Fukazawa et al. | 271/3.19 |
| 2011/0190109 | A1 | 8/2011 | Kimata | |
| 2011/0294639 | A1 | 12/2011 | Imazu et al. | |

FOREIGN PATENT DOCUMENTS

| | | | |
|---|---|---|---|
| CN | 102050356 | A | 11/2015 |
| EP | 2189953 | A1 | 5/2010 |
| JP | 07309525 | A | 11/1995 |
| JP | 3257899 | | 12/2001 |
| JP | 2007-277006 | | 10/2007 |
| JP | 2011126658 | | 6/2011 |

* cited by examiner

R1: FIRST PAIR OF CONVEYING ROLLERS
R2+R3: SECOND PAIR OF CONVEYING ROLLERS Rt1
R3+R4: THIRD PAIR OF CONVEYING ROLLERS Rt2
R3+R5: FOURTH PAIR OF CONVEYING ROLLERS Rt3
R6: FIFTH PAIR OF CONVEYING ROLLERS

SHEET PROCESSING APPARATUS, IMAGE FORMING SYSTEM, AND SHEET CONVEYING METHOD

CROSS-REFERENCE TO RELATED APPLICATIONS

The present application claims priority to and incorporates by reference the entire contents of Japanese Patent Application No. 2013-120880 filed in Japan on Jun. 7, 2013 and Japanese Patent Application No. 2014-035722 filed in Japan on Feb. 26, 2014.

BACKGROUND OF THE INVENTION

1. Field of the Invention

The present invention relates generally to a sheet processing apparatus, an image forming system, and a sheet conveying method, and more particularly, to a sheet processing apparatus that folds a sheet of recording medium (hereinafter, "sheet") such as plain paper, transfer paper, printing paper, or an overhead transparency film conveyed to the apparatus, an image forming system including the sheet processing apparatus and an image forming apparatus such as a copier, a printer, facsimile, or a digital multifunction peripheral, and a sheet conveying method performed by the sheet processing apparatus.

2. Description of the Related Art

A technique of folding a sheet by deflecting a sheet in a space between two pairs of rollers and pinching the deflecting portion in a nip formed between another pair of rollers is already known. Known examples of such a technique include that disclosed in Japanese Laid-open Patent Publication No. 2007-277006.

The technique disclosed in Japanese Laid-open Patent Publication No. 2007-277006 provides a method for folding a medium by a folding apparatus which includes a rotatable folding cylinder, a first rotatable press member capable of engaging with the folding cylinder to form a first folding pinch, a second rotatable press member capable of engaging with the folding cylinder to form a second folding pinch, and medium feed means. The method includes: a) feeding, by the medium feed means, a medium toward the cylinder located midway between the first pinch and the second pinch; b) directing the medium into the first pinch by rotating the cylinder in a first direction; c) forming a slack in the medium at a position between the feed means and the cylinder; and d) conveying the slack of the medium into the second pinch by rotating the cylinder in a second direction, which is opposite to the first direction.

The conventional technique described above folds a sheet by causing one of the two pairs of cylinders (hereinafter, referred to as "two pairs of rollers") to convey the sheet forward while causing the other one to convey the sheet backward so that the sheet is deflected at the position between the two pairs of rollers, and pinching the deflected portion in a roller nip.

Such a sheet folding apparatus that folds a sheet by deflecting the sheet in a space between two pairs of conveying members and pinching the deflected portion in a nip of another pair of rollers generally has a path for conveying the sheet to a downstream apparatus and a path for performing the folding process separately. This is because the folding process requires a space for deflecting the sheet by rotating the conveying members backward. Furthermore, to fold a sheet in half-fold, it is necessary to guide a leading end of the sheet to another path than the path for conveying the sheet. Accordingly, conventionally, apparatuses capable of a plurality of folding types have been disadvantageously large in size due to the necessity of having the plurality of paths and space.

Meanwhile, a sheet folding apparatus in which a path for conveying a sheet to a downstream apparatus and a path for performing a folding process are not separated but a sheet folded on a conveying path is conveyed to a downstream apparatus along the same conveying path, is already known. An example of such a sheet folding apparatus is disclosed in Japanese Patent No. 3257899.

This sheet folding apparatus includes: first and third conveying means which convey a sheet substantially horizontally; second conveying means which conveys the sheet conveyed by the first conveying means substantially vertically and is to be driven forward and backward; and switching means which switches from one sheet conveying path to another in a region surrounded by the first, second, and third conveying means. A length of the sheet conveying path between the first and third conveying means is set so as to satisfy a predetermined relationship. Reversing means, which turns a sheet upside down by changing timing at which the switching means should switch the sheet conveying path, also serves as folding means which folds the sheet at a predetermined position.

This sheet folding apparatus includes a member referred to as a flapper for switching a path of a sheet leading end and for assisting a folding process at a bifurcating point. The flapper serves not only as the switching means but also as the folding means.

The flapper of the sheet folding apparatus disclosed in Japanese Patent No. 3257899 includes an upper bifurcating claw and a lower bifurcating claw. The flapper is configured such that the lower bifurcating claw rotates so as to follow rotation of the upper bifurcating claw at the sheet conveying path surrounded by the first through third pairs of conveying rollers. By rotating the lower bifurcating claw in the manner to follow the rotation of the upper bifurcating claw or, in other words, by rotating the upper bifurcating claw and the lower bifurcating claw in synchronization with each other, the reversing means can function also as the folding means.

However, this configuration in which the upper bifurcating claw and the lower bifurcating claw are rotated in synchronization with each other has the following disadvantage. A crease is formed by making use of a folding edge of the lower bifurcating claw. The conveying members are rotated backward by an amount which depends on a position where the crease is to be formed. In contrast to the technique disclosed in Japanese Laid-open Patent Publication No. 2007-277006, with this configuration, it is impossible to fold a sheet by guiding a deflected portion, which is formed by rotating the conveying members backward, to a nip between the conveying members which perform folding.

For this reason, to fold a sheet using the technique disclosed in Japanese Patent No. 3257899 by guiding a deflected portion, which is formed by rotating the conveying members backward, to the nip between the conveying members which perform folding, it is necessary to add means therefor. However, addition of such means will undesirably result in an increase in size of the apparatus.

Under the circumstances, there is a need for downsizing a sheet processing apparatus capable of folding a sheet using rollers.

SUMMARY OF THE INVENTION

It is an object of the present invention to at least partially solve the problems in the conventional technology.

A sheet processing apparatus includes: a first pair of conveying members and a third pair of conveying members that convey a sheet; a second pair of conveying members that receives the sheet conveyed by the first pair of conveying members and conveys the sheet downstream; and a bifurcating claw that moves to a first guiding position for guiding the sheet to the second pair of conveying members, a second guiding position for guiding a deflected portion of the sheet to the third pair of conveying members, and a third guiding position for guiding a leading end of the sheet to the third pair of conveying members. The second pair of conveying members is rotated backward in a state in which the sheet is held by the first pair of conveying members and the second pair of conveying members, to guide the deflected portion to the third pair of conveying members and cause the deflected portion to be folded by the third pair of conveying members.

An image forming system includes such a sheet processing apparatus.

A sheet conveying method is for a sheet processing apparatus including: a first pair of conveying members and a third pair of conveying members that convey a sheet, a second pair of conveying members that receives the sheet conveyed by the first pair of conveying members and conveys the sheet downstream, and a bifurcating claw that moves to a first guiding position for guiding the sheet to the second pair of conveying members, a second guiding position for guiding a deflected portion of the sheet to the third pair of conveying members, and a third guiding position for guiding a leading end of the sheet to the third pair of conveying members. The sheet conveying method includes: if the sheet conveyed by the first pair of conveying members is to be directly conveyed to a downstream apparatus, bringing the bifurcating claw to the first guiding position for guiding the sheet to the second pair of conveying members; if the sheet is to be folded by the third pair of conveying members, bringing the bifurcating claw to the second guiding position for guiding the deflected portion of the sheet to the third pair of conveying members; if the sheet is to be folded by the third pair of conveying members or is to be folded at a position downstream of the third pair of conveying members, bringing the bifurcating claw to the third guiding position for guiding the sheet to the third pair of conveying members and conveying the sheet; and if the sheet is to be folded by the third pair of conveying members, rotating the second pair of conveying members backward in a state in which the sheet is held by the first pair of conveying members and the second pair of conveying members to guide the deflected portion toward the third pair of conveying members and cause the deflected portion to be folded by the third pair of conveying members.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIGS. 13A to 13H are diagrams illustrating how a sheet is folded in letter fold-in;

DETAILED DESCRIPTION OF THE PREFERRED EMBODIMENTS

According to an aspect of the present invention, a sheet processing apparatus includes, in a specific space, a bifurcating claw which provides three functions: conveying a sheet to a downstream apparatus; guiding a leading end of a sheet to a folding unit; and guiding a deflected portion, which is formed in a folding process, of a sheet.

Exemplary embodiments of the present invention are described in detail below with reference to the accompanying drawings. In the following description, like reference designators refer to same or similar elements, for which reason repeated description is dispensed with below.

Figure 1:
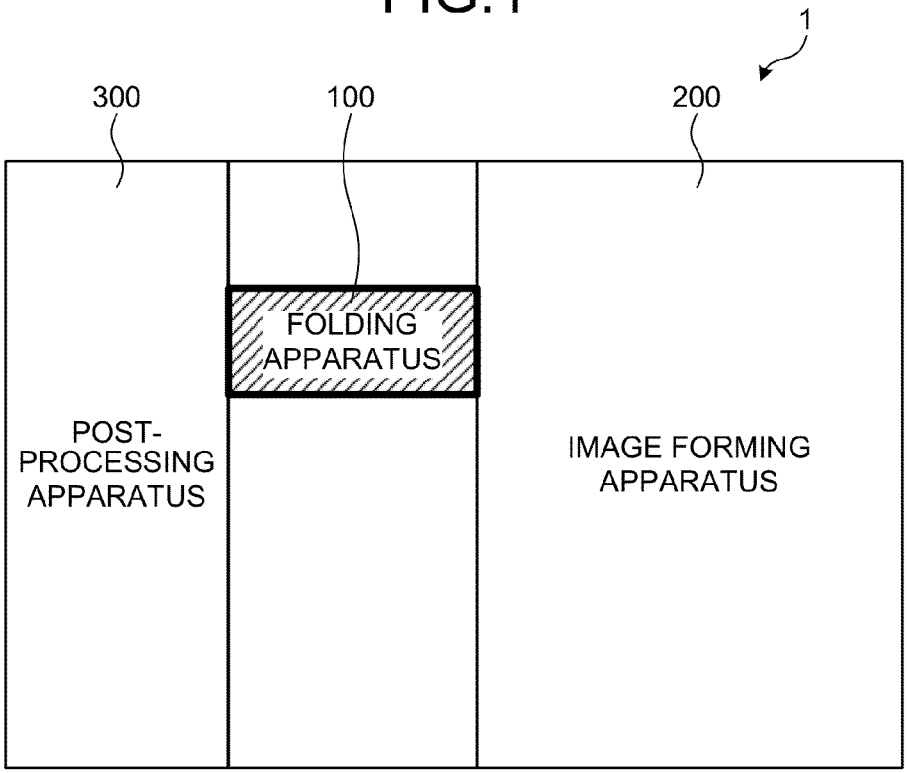
FIG. 1 is a diagram of a schematic configuration of an image forming system according to an embodiment of the present invention.

FIG. 1 is a diagram of a schematic configuration of an image forming system according to an embodiment of the present invention. Referring to FIG. 1, an image forming system 1 according to this embodiment includes an image forming apparatus 200, a folding apparatus 100 as a sheet processing apparatus, and a post-processing apparatus 300. The folding apparatus 100 is interposed between the image forming apparatus 200 as an upstream apparatus and the post-processing apparatus 300 as a downstream apparatus. A sheet, on which an image is formed by the image forming apparatus 200, is conveyed into the folding apparatus 100. After being folded through a predetermined folding process in the folding apparatus 100, the sheet is further delivered to the post-processing apparatus 300. The post-processing apparatus 300 performs a finishing process, such as an aligning process, a stapling process, and/or a binding process, on a folded sheet or an unfolded sheet.

An electrophotographic image forming apparatus can be used as the image forming apparatus 200, for example. However, an employable image forming method is not limited to electrophotography, and any image forming apparatus capable of forming an image on a sheet using a known image forming method, such as liquid-droplet ejecting printing or letterpress printing, can be used as the image forming apparatus 200.

Figure 2:
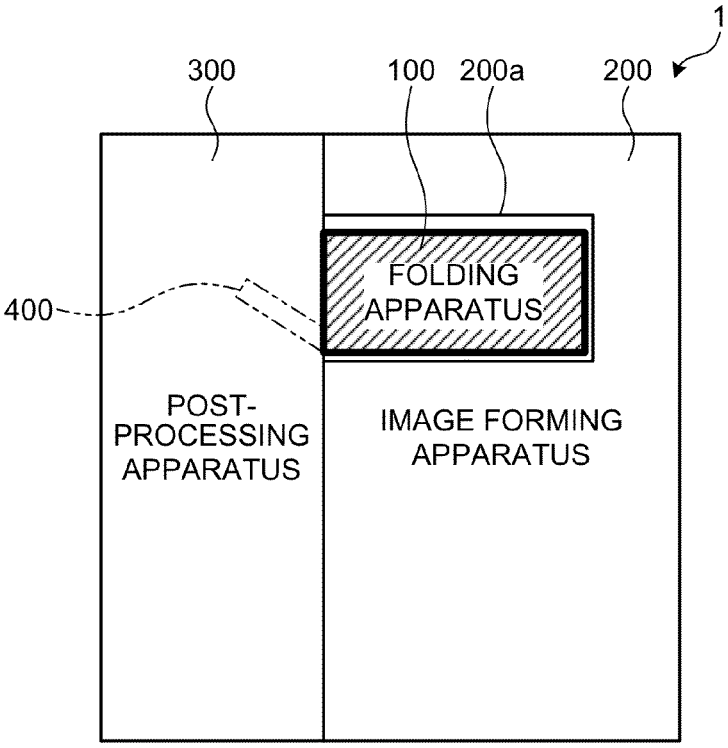
FIG. 2 is a diagram of a schematic configuration of an image forming system according to another embodiment of the present invention.

FIG. 2 is a diagram of a schematic configuration of an image forming system according to another embodiment of the present invention. Referring to FIG. 2, the folding apparatus 100 is of what is referred to as an internal type which is located in a sheet output unit inside the image forming apparatus 200. In the image forming system 1 illustrated in FIG. 2, the folding apparatus 100 is in an internal sheet-output space 200*a* of the image forming apparatus 200. Because only a sheet output tray 400 projects out from a footprint of the image forming apparatus 200, the system is considerably compact as compared with that illustrated in FIG. 1.

Figure 3:
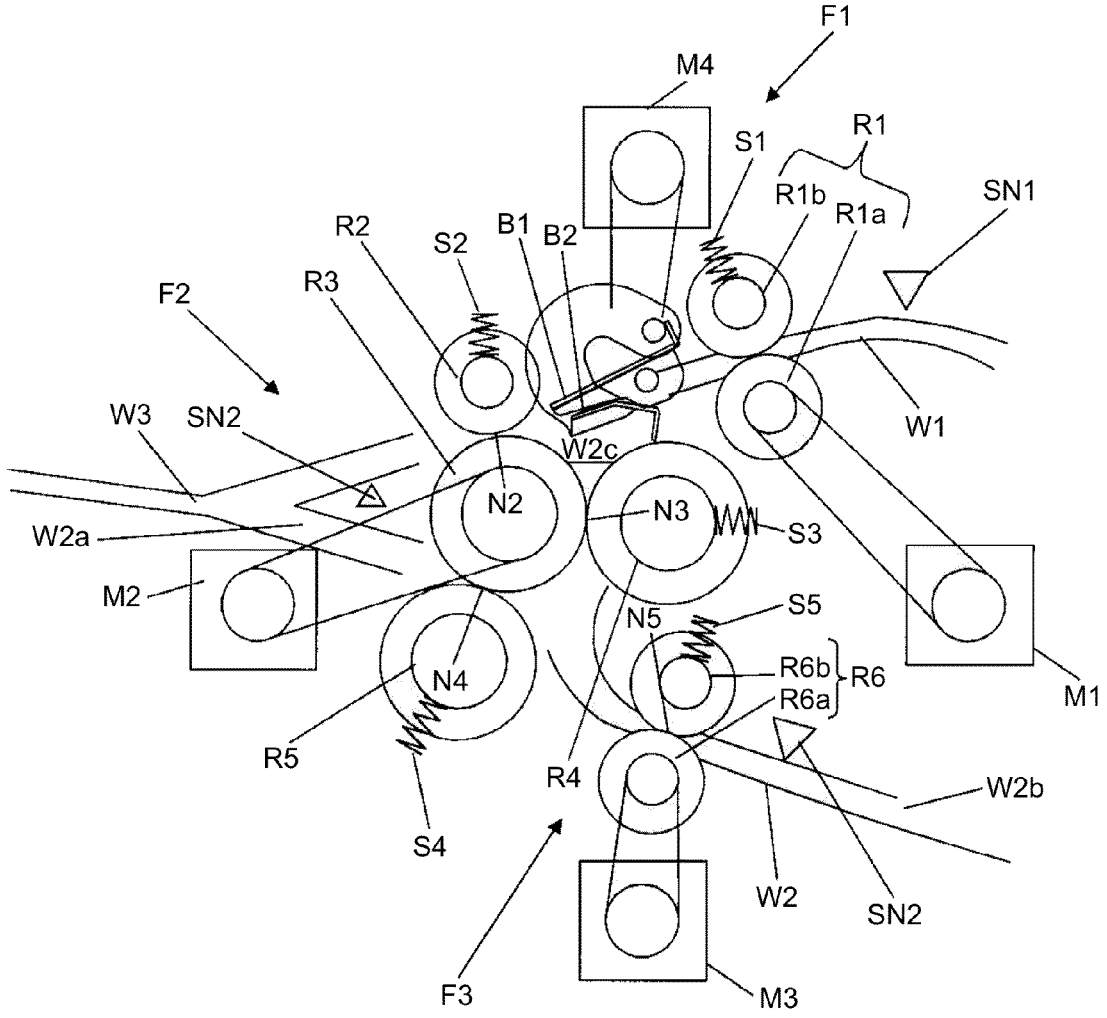
FIG. 3 is a diagram of a folding structure of the folding apparatus illustrated in FIGS. 1 and 2.

FIG. 3 is a diagram of a folding structure of the folding apparatus 100 illustrated in FIGS. 1 and 2.

The folding apparatus 100 includes two conveying paths, which are a first conveying path W1 and a second conveying path W2. First to third conveying units F1, F2, and F3 are arranged along these two conveying paths W1 and W2. The second conveying unit F2 is arranged so as to connect between the first conveying path W1 and the second conveying path W2 and provides functions of receiving a sheet P from the first conveying path W1, folding the sheet P, and passing the folded sheet P to the second conveying path W2.

The first conveying unit F1 includes a first pair of conveying rollers R1. The second conveying unit F2 includes first through fourth conveying rollers R2, R3, R4, and R5. The third conveying unit F3 includes a fifth pair of conveying rollers R6. The first pair of conveying rollers R1 (the first conveying unit F1) is driven by a first drive motor M1 and applies a conveying forth to the sheet P. The fifth pair of conveying rollers R6 (the third conveying unit F3) is driven by a third drive motor M3 and applies a conveying forth to the sheet P. In the second conveying unit F2, the first conveying roller R2 and the second conveying roller R3 form a second pair of conveying rollers Rt1; the second conveying roller R3 and the third conveying roller R4 form a third pair of conveying rollers Rt2; the second conveying roller R3 and the fifth conveying roller R5 form a fourth pair of conveying rollers Rt3.

The first pair of conveying rollers R1 is arranged on the first conveying path W1 at a position near an entrance of the folding apparatus 100 and driven by the first drive motor M1 to receive the sheet P from the image forming apparatus 200 and convey the sheet P downstream in the folding apparatus 100.

The second conveying path W2 in this embodiment has an end W2*a* (not shown) on a downstream side (sheet output side) in a sheet conveying direction. The second conveying path W2 merges at the end W2*a* with a downstream end of the first conveying path W1 to form a third conveying path W3. The second conveying path W2 has, on the upstream side in the sheet conveying direction, an end W2*b* which merges with an upstream side of the first pair of conveying rollers R1 or which is open as illustrated in FIG. 3. The second conveying path W2 is connected via a connecting path W2*c* to the first conveying path W1 at a position which is downstream of the first pair of conveying rollers R1 and at which the second conveying unit F2 is arranged.

In the second conveying unit F2, the first and second conveying rollers R2 and R3 facing each other across the first conveying path W1 form the second pair of conveying rollers Rt1 with a second nip N2 therebetween. The second and third conveying rollers R3 and R4 facing each other in a space between the first conveying path W1 and the second conveying path W2 form the third pair of conveying rollers Rt2 with a third nip N3 therebetween. A path, along which the third nip N3 guides a sheet, functions as the connecting path W2*c* which guides the sheet from the first conveying path W1 to the second conveying path W2. The second and fourth conveying rollers R3 and R5 facing each other across the second conveying path W2 form the fourth pair of conveying rollers Rt3 with a fourth nip N4 therebetween.

The first through fourth conveying rollers R2 through R5 are driven by a second drive motor M2 which drives the second conveying roller R3. In other words, the second conveying unit F2 is driven by the second drive motor M2. The second drive motor M2 is capable of rotating forward and backward. The second drive motor M2 conveys the sheet P and folds the sheet P by changing its rotating direction. The second conveying unit F2 may include, in place of the pair(s) of conveying rollers, gum rollers or suction belts.

In the second conveying unit F2, the second conveying roller R3 is a driving-conveying roller; in contrast, each of the first, third, and fourth conveying rollers R2, R4, and R5 is a driven conveying roller rotated while in contact with the second conveying roller R3 or with the sheet P between the roller and the second conveying roller R3. The second conveying roller R3 and the third conveying roller R4 (the third pair of conveying rollers Rt2) make up first folding rollers. The second conveying roller R3 and the fourth conveying roller R5 make up second folding rollers.

The first, third, and fourth conveying rollers R2, R4, and R5 are resiliently urged against the second conveying roller R3 by first, second, and third compression springs (elastic members) S2, S3, and S4, respectively, and placed in constant contact with the second conveying roller R3. Accordingly, a driving force applied from the second conveying roller R3 drives the other first, third, and fourth conveying rollers R2, R4, and R5.

The first pair of conveying rollers R1 is made up of a driving conveying roller R1*a* and a driven conveying roller R1*b*. The first drive motor M1 applies a driving force to the driving conveying roller R1*a*. The driven conveying roller R1*b* is resiliently urged by a first compression spring S1 against the driving conveying roller R1*a* into contact therewith at a first nip N1. The driven conveying roller R1*b* is rotated in this contact state. The fifth pair of conveying rollers R6 is made up of a driving conveying roller R6*a* and a driven conveying roller R6*b*. The third drive motor M3 applies a driving force to the driving conveying roller R6*a* synchronized via a gear mechanism. The driven conveying roller R6*b* is resiliently urged by a fifth compression spring S5 against the driving conveying roller R6*a* into contact therewith at a fifth nip N5. The driven conveying roller R6*b* is rotated in this contact state.

A first sheet-detection sensor SN1 is arranged on the first conveying path W1 at a position immediately upstream of the first pair of conveying rollers R1. A second sheet-detection sensor SN2 is arranged at a position immediately downstream of the nip between the first and second conveying rollers R2 and R3. A third sheet-detection sensor SN3 is arranged at the second conveying path W2 at a position immediately near the fifth pair of conveying rollers R6 on the side thereof opposite to the fourth conveying roller R5. The first sheet-detection sensor SN1 functions as a sheet-entry detection sensor. The second sheet-detection sensor SN2 functions as a sheet-output detection sensor.

Figure 4:
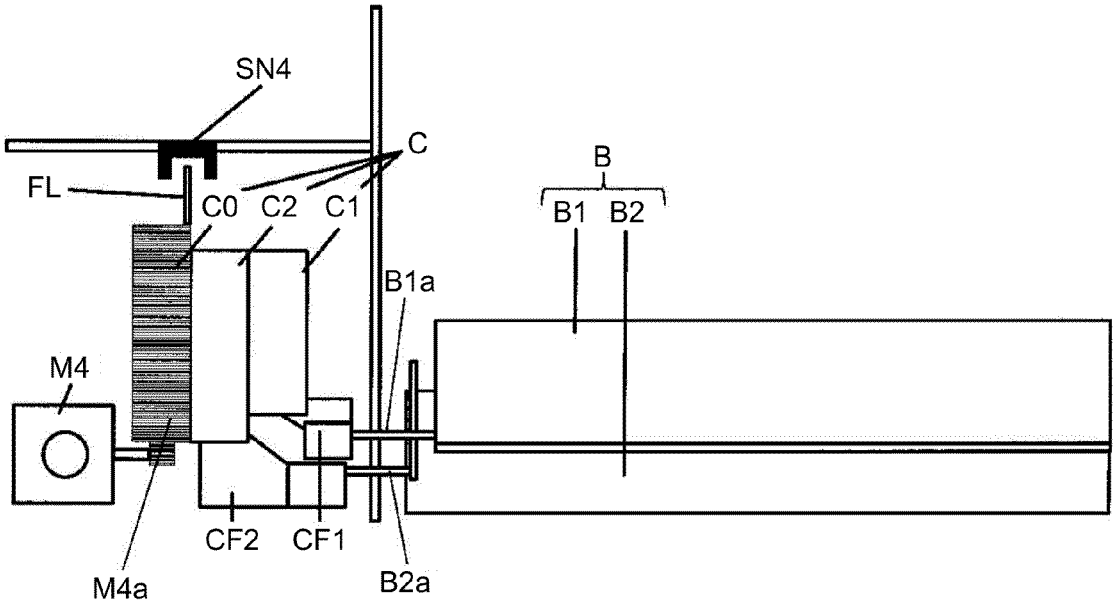
FIG. 4 is a plan view of the bifurcating claws illustrated in FIG. 3 and a drive mechanism therefor.
Figure 5:
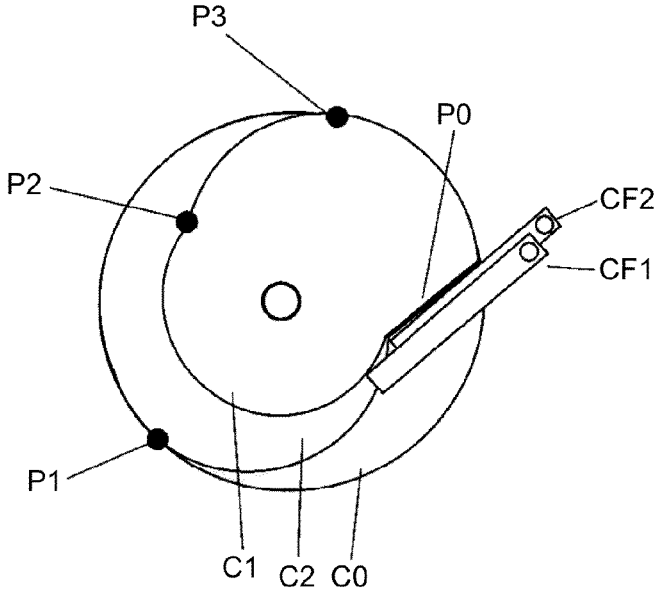
FIG. 5 is a front view of cams and cam followers which make up the drive mechanism illustrated in FIG. 4.

In this embodiment, an upper bifurcating claw B1 and a lower bifurcating claw B2 are on the first conveying path W1 at a position between the first pair of conveying rollers R1 and the second pair of conveying rollers Rt1. FIG. 4 is a plan view of the bifurcating claws and a drive mechanism therefor. FIG. 5 is a front view of cams and cam followers, which make up the drive mechanism, in their initial positions.

The upper and lower bifurcating claws B1 and B2 guide a sheet by moving, in relation to each other, to one of three (first to third) guiding positions. The first guiding position is a position for guiding the sheet P directly from the first conveying path W1 to the third conveying path W3. The second guiding position is a position for guiding a deflected portion, which is formed in a folding process, of the sheet P to the nip N3 between the third pair of conveying rollers Rt2. The third guiding position is a position for guiding a leading end of the sheet P to a downstream folding unit.

As illustrated in FIG. 4, positions of the upper and lower bifurcating claws B1 and B2 are changeable by first and second cam followers CF1 and CF2, which are on same revolving shafts B1*a* and B2*a* as the upper and lower bifurcating claws B1 and B2, respectively. More specifically, phases of the first and second cam followers CF1 and CF2 change depending on rotational positions of the first and second cam parts C1 and C2, which are in contact with the first and second cam followers CF1 and CF2, respectively. Accordingly, the first and second cam followers CF1 and CF2 are moved with the change in the phase. In conjunction with this, the positions of the upper and lower bifurcating claws B1 and B2 are respectively changed. The first and second cam parts C1 and C2 are driven by a fourth drive motor M4 that drives a composite cam C.

In other words, switching motions of the upper and lower bifurcating claws B1 and B2 occur in conjunction with the motions of the first and second cam followers CF1 and CF2 which are coaxially connected with the upper and lower bifurcating claws B1 and B2, respectively. The phases of the first and second cam followers CF1 and CF2 can be changed using the single composite cam C. As illustrated in FIG. 5, the composite cam C is formed by combining a toothed part C0, the first cam part C1, and the second cam part C2 into one. These components of the composite cam C do not rotate separately but integrally rotate.

The toothed part C0 is driven by the fourth drive motor M4 with teeth of the toothed part C0 meshed with a drive gear M4*a* of the fourth drive motor M4. The perimeter of the first cam part C1 is shorter than that of the second cam part C2. The first cam follower CF1 that moves the upper bifurcating claw B1 is in contact with the perimeter of the first cam part C1. The second cam follower CF2 that moves the lower bifurcating claw B2 is in contact with the perimeter of the second cam part C2. The first and second cam parts C1 and C2 coaxially and integrally rotate when the composite cam C is rotated by the fourth drive motor M4. As the composite cam C rotates, each of the first cam follower CF1, which is in contact with the perimeter of the first cam part C1, and the second cam follower CF2, which is in contact with the perimeter of the second cam part C2, is rotated through a phase difference (angle). The first cam part C1 and the second cam part C2 have different cam shapes. Arranging the cam followers CF1 and CF2, which are linked to the switching motions of the upper and lower bifurcating claws B1 and B2, respectively and separately on the perimeters of the first and second cam parts C1 and C2 makes it possible to move the upper and lower bifurcating claws B1 and B2 to the three guiding positions (forms) using the single motor.

Figure 6A:
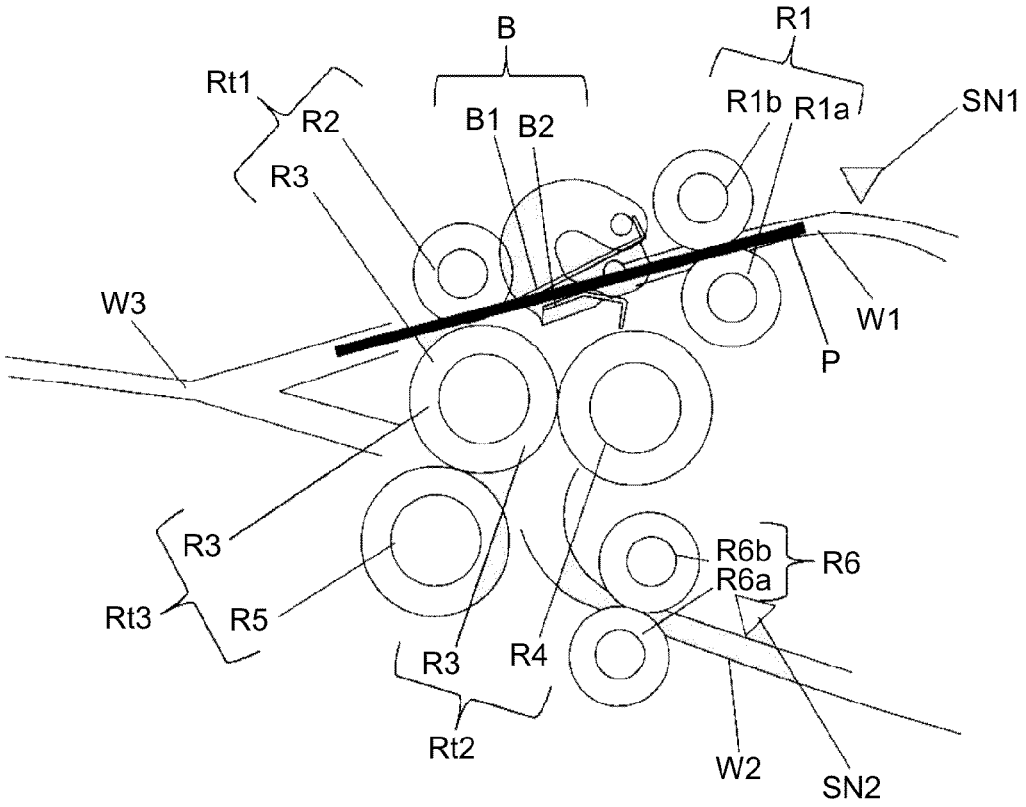
FIGS. 6A to 6C are diagrams illustrating a state (for pass-through conveyance) in which upper and lower bifurcating claws are in a first guiding position for guiding a sheet to a second pair of conveying rollers.
Figure 6B:
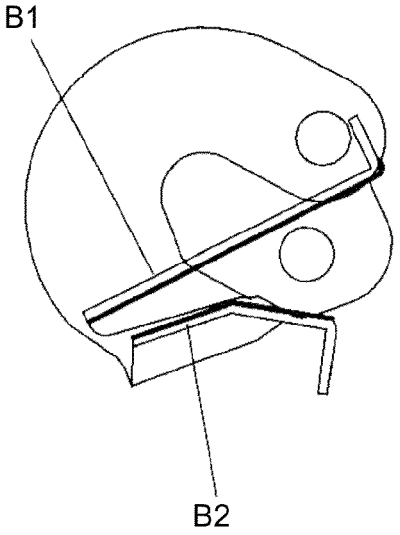
Figure 6C:
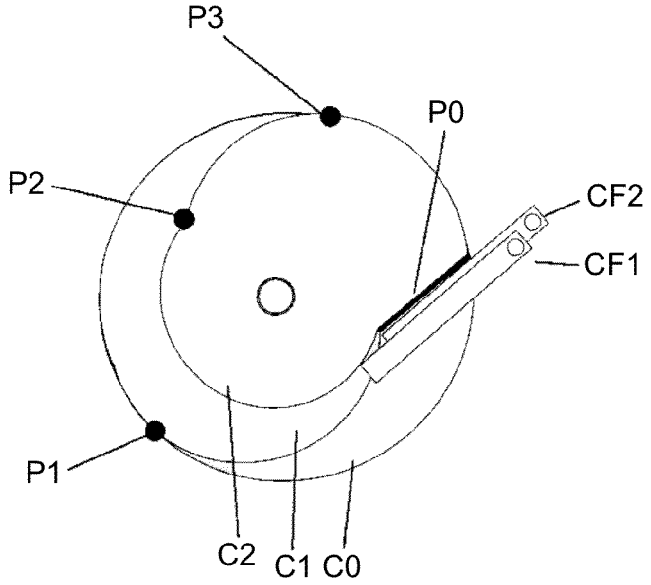
Figure 7A:
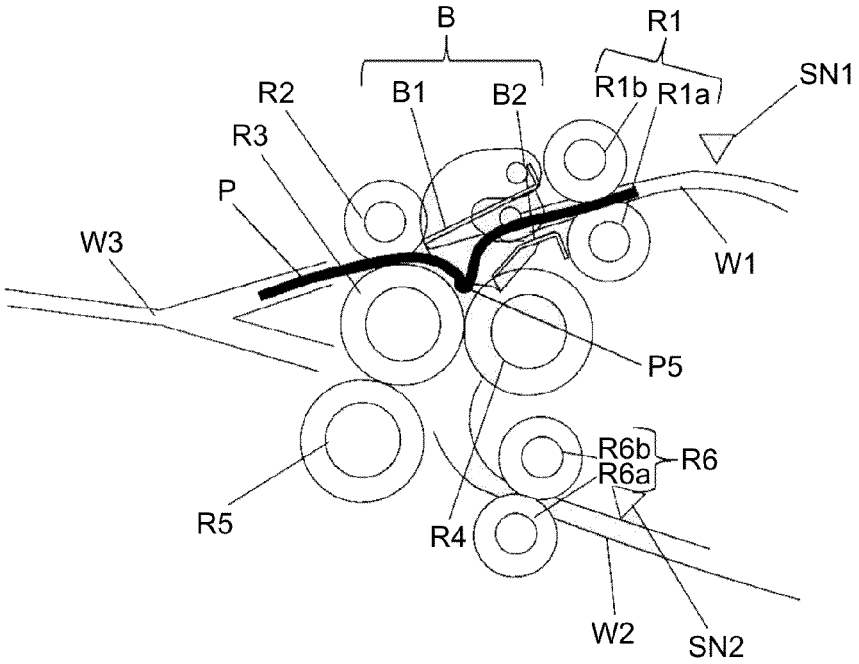
FIGS. 7A to 7C are diagrams illustrating a state in which the upper and lower bifurcating claws are in a second guiding position to convey a deflected portion of a sheet to a third pair of conveying rollers.
Figure 7B:
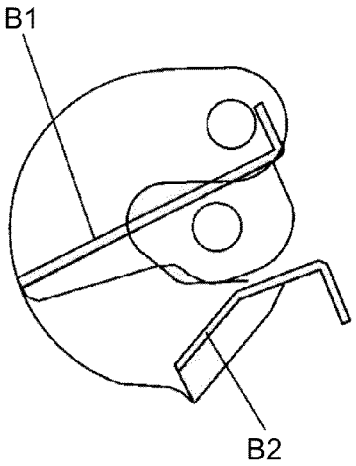
Figure 7C:
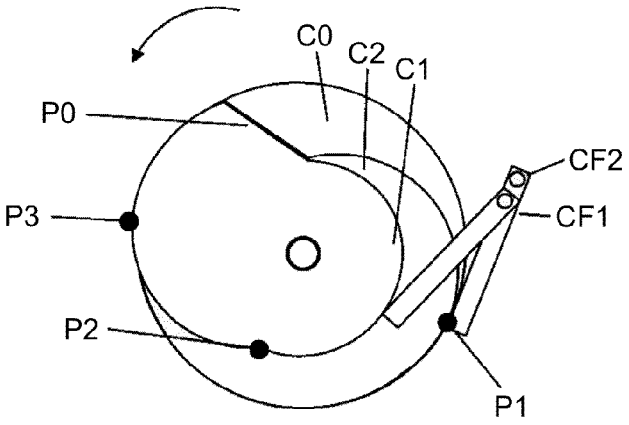
Figure 8A:
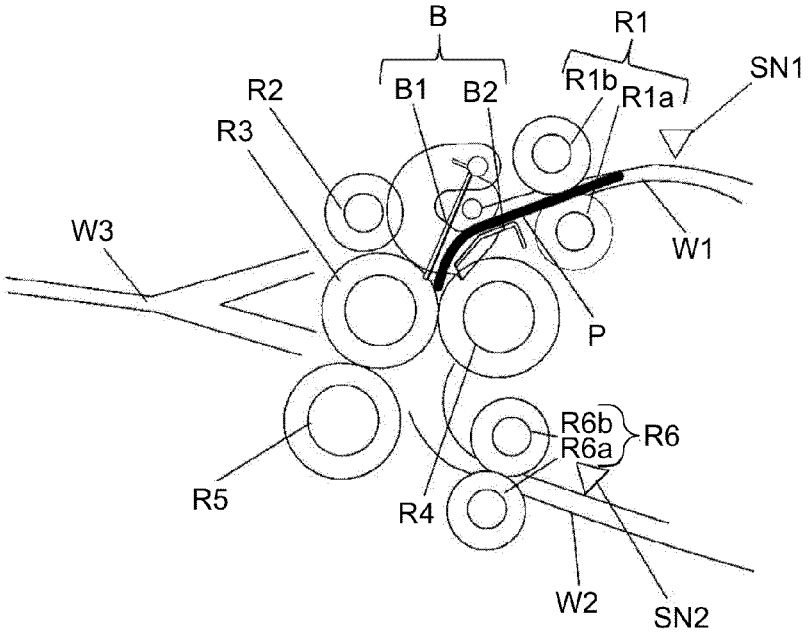
FIGS. 8A to 8C are diagrams illustrating a state for half-fold in which the upper and lower bifurcating claws are in a third guiding position to convey a leading end of a sheet to the third pair of conveying rollers.
Figure 8B:
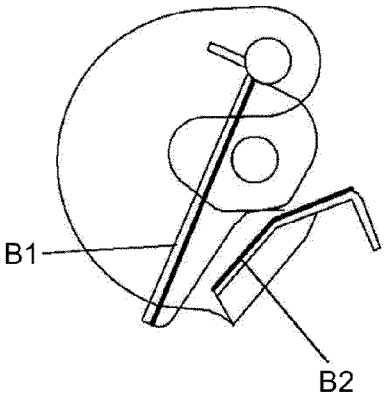
Figure 8C:
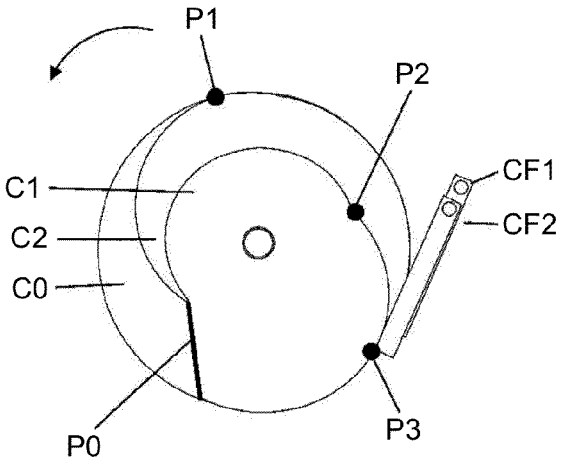

FIGS. 6A to 6C are diagrams illustrating a state (for pass-through conveyance) in which the upper and lower bifurcating claws B1 and B2 are in the first guiding position for guiding and conveying the sheet P to the second pair of conveying rollers Rt1. FIGS. 7A to 7C are diagrams illustrating a state in which the upper and lower bifurcating claws B1 and B2 are in the second guiding position for guiding and conveying a deflected portion of the sheet P to the third pair of conveying rollers Rt2. FIGS. 8A to 8C are diagrams illustrating a state for half-fold in which the upper and lower bifurcating claws B1 and B2 are in the third guiding position for guiding and conveying the leading end of the sheet P to the third pair of conveying rollers Rt2. Each of FIGS. 6A, 7A, and 8A illustrates the upper and lower bifurcating claws B1 and B2 conveying the sheet P. Each of FIGS. 6B, 7B, and 8B illustrates the upper and lower bifurcating claws B1 and B2. Each of FIGS. 6C, 7C, and 8C illustrates relationship of the composite cam C to the first and second cam followers CF1 and CF2.

FIGS. 6A to 6C illustrate the upper and lower bifurcating claws B1 and B2 in their initial positions. In this state, the sheet P received from the first conveying path W1 is conveyed in a direction for route via the first and second conveying rollers R2 and R3 (the second pair of conveying rollers Rt1). The sheet P is guided from this position either directly to the third conveying path W3 or, by causing the second pair of conveying rollers Rt1 to rotate backward, toward the third pair of conveying rollers Rt2.

Meanwhile, the upper and lower bifurcating claws B1 and B2 can be positioned in their initial positions in the following manner. A feeler FL is attached to the toothed part C0 as illustrated in FIG. 4. The composite cam C is stopped after a lapse of a predetermined period of time or after rotating for a predetermined number of pulses since the feeler FL is detected by a position detecting sensor SN4, which is arranged on a locus of the feeler FL. FIG. 6C illustrates positional relationship of the composite cam C to the first and second cam followers CF1 and CF2 in the stopped state.

Folding the sheet P in z-fold or tri-fold, which will be described in detail later, is performed by, in short, causing the second drive motor M2 to rotate the third conveying roller R2 backward after the sheet P has passed through the second pair of conveying rollers Rt1, thereby deflecting the sheet P. A deflected portion is formed in a space of the connecting path W2*c* immediately upstream of the nip N3 of the third pair of conveying rollers Rt2. The deflected portion projects toward the third nip N3 between the first folding rollers (i.e. the third pair of conveying rollers Rt2). Thereafter, the deflected portion is pinched in the third nip N3, whereby the sheet P is folded.

To fold the sheet P in this manner, it is necessary to place the upper and lower bifurcating claws B1 and B2 in the form illustrated in FIG. 7B so that the deflected portion P5 is guided to the third nip N3 between the third pair of conveying rollers Rt2. More specifically, space for guiding the sheet P to the third nip N3 is created by tilting, or rotating, the lower bifurcating claw B2 downward from the state illustrated in FIGS. 6A to 6C. To tilt, or rotate, the lower bifurcating claw B2, the composite cam C is rotated from an initial contact position P0 of the second cam part C2 to a first position P1, at which the phase difference becomes constant. As the composite cam C is rotated in this manner, the second cam follower CF2 which is in contact with the second cam part C2 tilts, causing the lower bifurcating claw B2 which is coaxial with the revolving shaft B2*a* of the second cam follower CF2 to integrally tilt. Meanwhile, even when the composite cam C is rotated from the initial position P0 to the first position P1, phase difference is not produced by the first cam follower CF1, and therefore the first cam follower CF1 does not tilt.

To fold the sheet P in half-fold, the form illustrated in FIGS. 8A to 8C, rather than those illustrated in FIGS. 6A to 7C, is used. It is necessary to guide the sheet P by tilting not only the lower bifurcating claw B2 but also the upper bifurcating claw B1 downward so that the sheet P directly advances to between the third pair of conveying rollers Rt2 without passing through the second pair of conveying rollers Rt1. To place the upper and lower bifurcating claws B1 and B2 in the form illustrated in FIGS. 8A to 8C, the composite cam C is further rotated from the position illustrated in FIGS. 7A to 7C.

The phase difference (relative tilt) of the first and second cam followers CF1 and CF2 is constant over the range from the first position P1 to a second position P2. When the composite cam C is further rotated from the second position P2, phase difference is produced by the first cam part C1. This phase difference tilts the first cam follower CF1 as does the second cam follower CF2, causing the bifurcating claw B1 which is coaxial with the revolving shaft B1*a* of the first cam follower CF1 to tilt.

Further rotating the composite cam C from a third position P3, at which the phase difference becomes constant, brings the first and second cam followers CF1 and CF2 to the initial position P0 again. Thus, the upper and lower bifurcating claws B1 and B2 are returned to the form illustrated in FIGS. 6A to 6C.

The upper and lower bifurcating claws B1 and B2 can be moved to any one of the three forms by the single drive source (the composite cam C and the fourth drive motor M4) as described above. This considerably contributes to downsizing of the apparatus.

Figure 9:
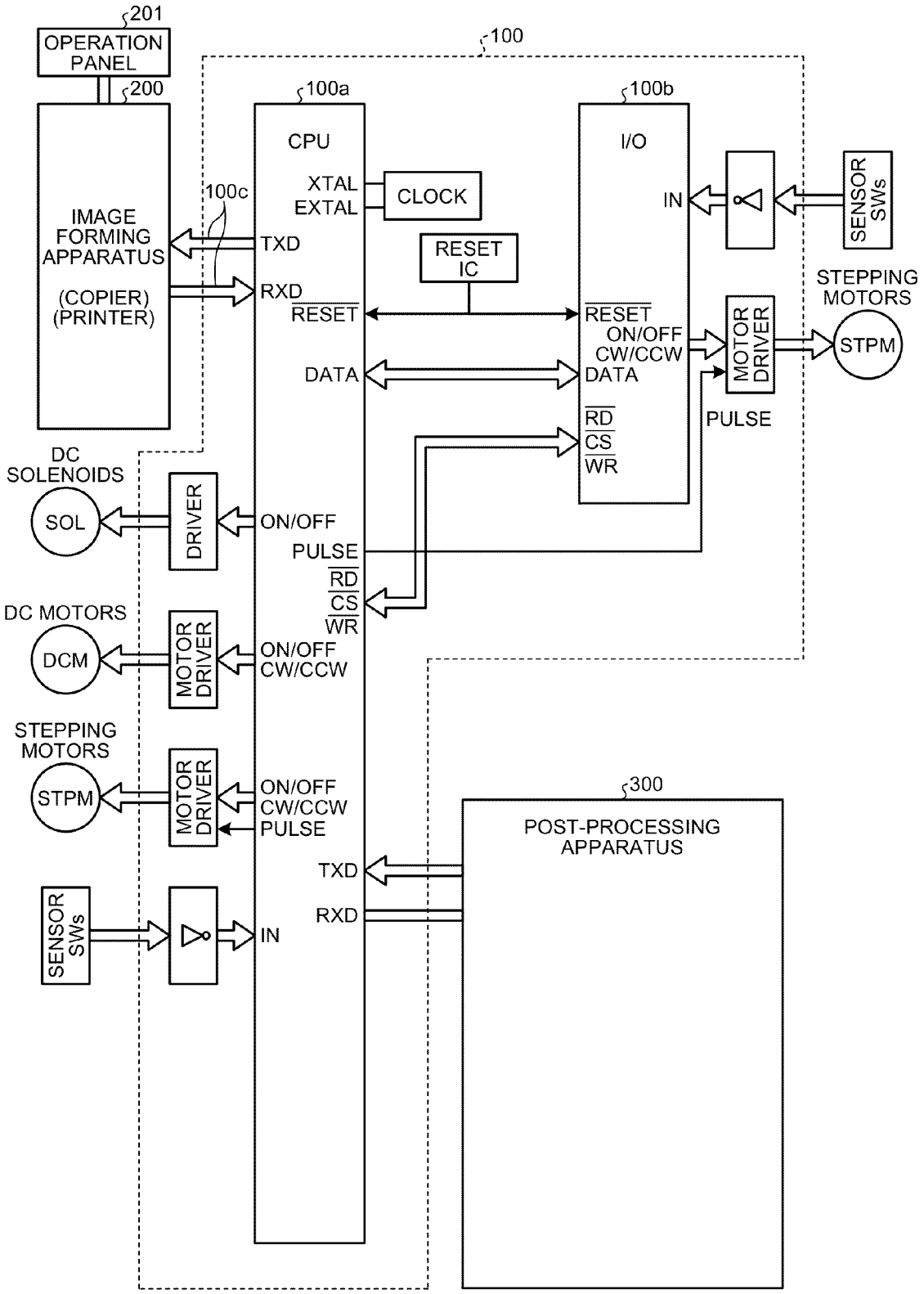
FIG. 9 is a block diagram of a control structure of the image forming system according to the embodiment.

FIG. 9 is a block diagram illustrating a control structure of the image forming system according to the embodiment.

Referring to FIG. 9, the folding apparatus 100 includes a control circuit on which a microcomputer including a CPU 100*a* and an I/O interface 100*b* is mounted. The CPU 100*a* receives signals from, a CPU, sheet detection sensors (not shown), and switches and the like of an operation panel 201 of the image forming apparatus 200 via a communication interface 100*c*. The CPU 100*a* executes a predetermined control operation according to a signal fed from the image forming apparatus 200. The CPU 100*a* further provides drive control of a solenoid and a motor using a driver and a motor driver, and acquires sheet detection information from a sheet detection sensor in the apparatus via the interface. The CPU 100*a* may further provide drive control of, for example, a motor of a to-be-controlled entity using a motor driver via the I/O interface 100*b*, and acquires sheet detection information from a sheet detection sensor.

The control operation described above is executed by the CPU 101*a* according to a program defined by a program code stored in a ROM (not shown) by reading out the program code, loading it in a RAM (not shown), and using the RAM as a working area and a data buffer.

In this embodiment, the folding mechanism illustrated in FIG. 3 can fold a sheet in any one of half-fold, z-fold, letter fold-in, and letter fold-out. Folding sheets in these folding types and drive control of rotating the rollers, which will be described later, are directed by and performed under control of the CPU 100*a* illustrated in FIG. 9.

Operations involved in folding processes to be performed by the folding apparatus 100 are described below.

Figure 10A:
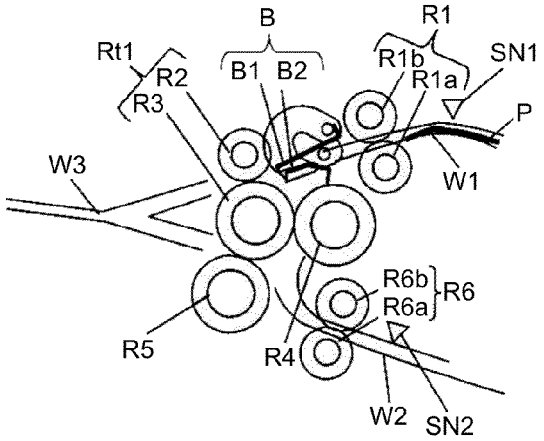
FIGS. 10A to 10C are diagrams describing pass-through conveyance of conveying a sheet downstream without folding the sheet.
Figure 10B:
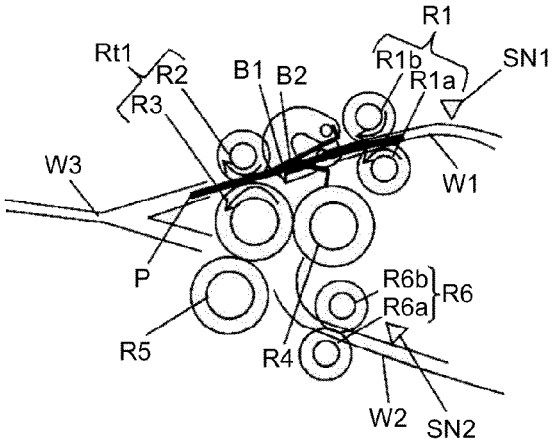
Figure 10C:
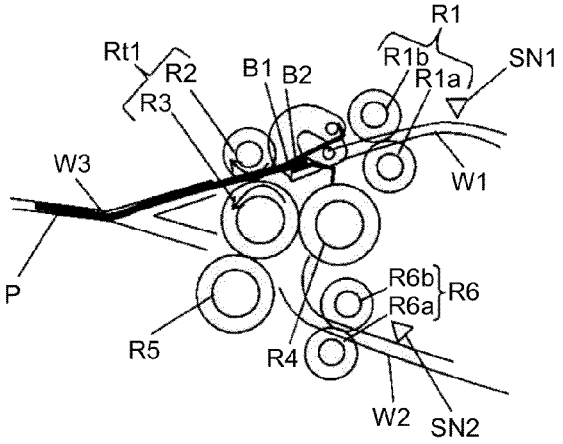

FIGS. 10A to 10C are diagrams describing pass-through conveyance of conveying the sheet P downstream without folding the sheet P.

The pass-through conveyance is performed as follows. When a leading end P1 of the sheet P conveyed from the image forming apparatus 200 to the first conveying path W1 is detected by the first sheet-detection sensor SN1, whether or not the composite cam C is in its initial position is determined. The initial position is the position where the composite cam C is stopped after the lapse of the predetermined period of time or after rotating for the predetermined number of pulses since the feeler FL is detected by the position detecting sensor SN4. If the composite cam C is not in its initial position, the fourth drive motor M4 is driven to rotate the composite cam C to the initial position.

When the leading end P1 of the sheet P is detected by the first sheet-detection sensor SN1 and it is determined that the composite cam C is in its initial position, the first pair of conveying rollers R1 starts rotating. At a point in time when the leading end P1 of the sheet P advances into the first nip N1 between the first pair of conveying rollers R1, the sheet P is conveyed to the second pair of conveying rollers Rt1. FIG. 10A is a diagram of a state immediately after the entry sensor SN1 has detected entry of the sheet. In this state, the composite cam C is in its initial position; movable ends of the upper and lower bifurcating claws B1 and B2 are open in the downstream direction of the first conveying path W1. In this state, the sheet P is conveyed to the second pair of conveying rollers Rt1.

The sheet P guided to between the upper and lower bifurcating claws B1 and B2 by the first pair of conveying rollers R6 is directly guided to the exit of the upper and lower bifurcating claws B1 and B2 and conveyed to the downstream end of the first conveying path W1. The sheet P is pinched by the second nip N2 between the second pair of conveying rollers Rt1 and conveyed to the third conveying path W3 as illustrated in FIG. 10C.

FIGS. 11A to 11H are diagrams describing how a sheet is folded in z-fold. FIG. 12 is a flowchart illustrating the steps of FIGS. 11A to 11H.

Figure 16A:
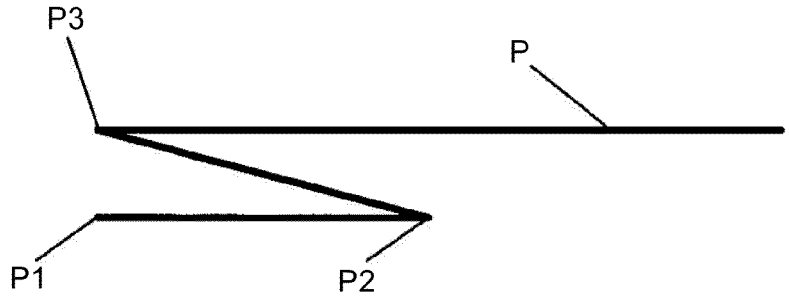
FIGS. 16A to 16C are diagrams describing sheets each folded in one of tri-fold variations (z-fold, letter fold-in, and letter fold-out)
Figure 16B:
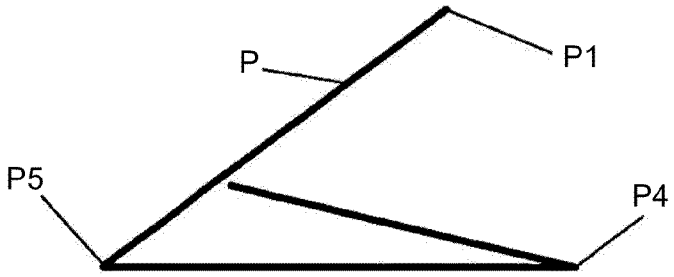
Figure 16C:
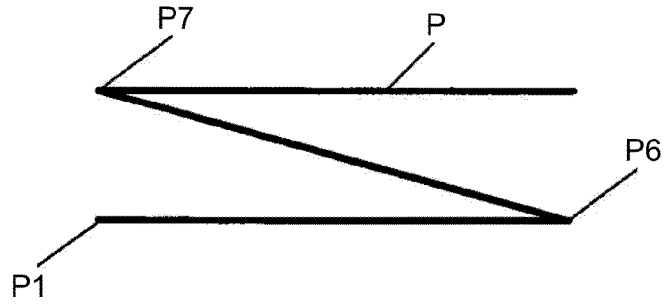

Z-fold is one of tri-fold variations illustrated in FIGS. 16A to 16C. As illustrated in FIG. 16A, Z-fold is performed by outwardly folding (first folding) the sheet P at a position one-fourth of the total length of the sheet P from the leading end P1 in the sheet conveying direction, and then inwardly folding (second folding) the sheet P at a position one half of the total length.

Figure 11A:
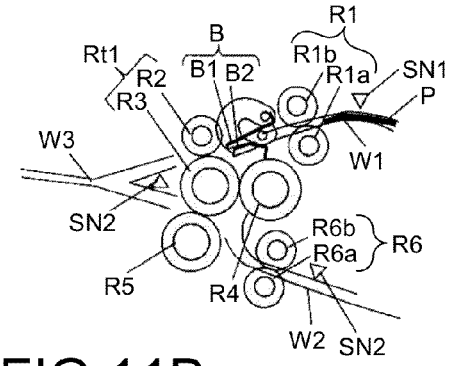
FIGS. 11A to 11H are diagrams illustrating how a sheet is folded in z-fold.
Figure 12:
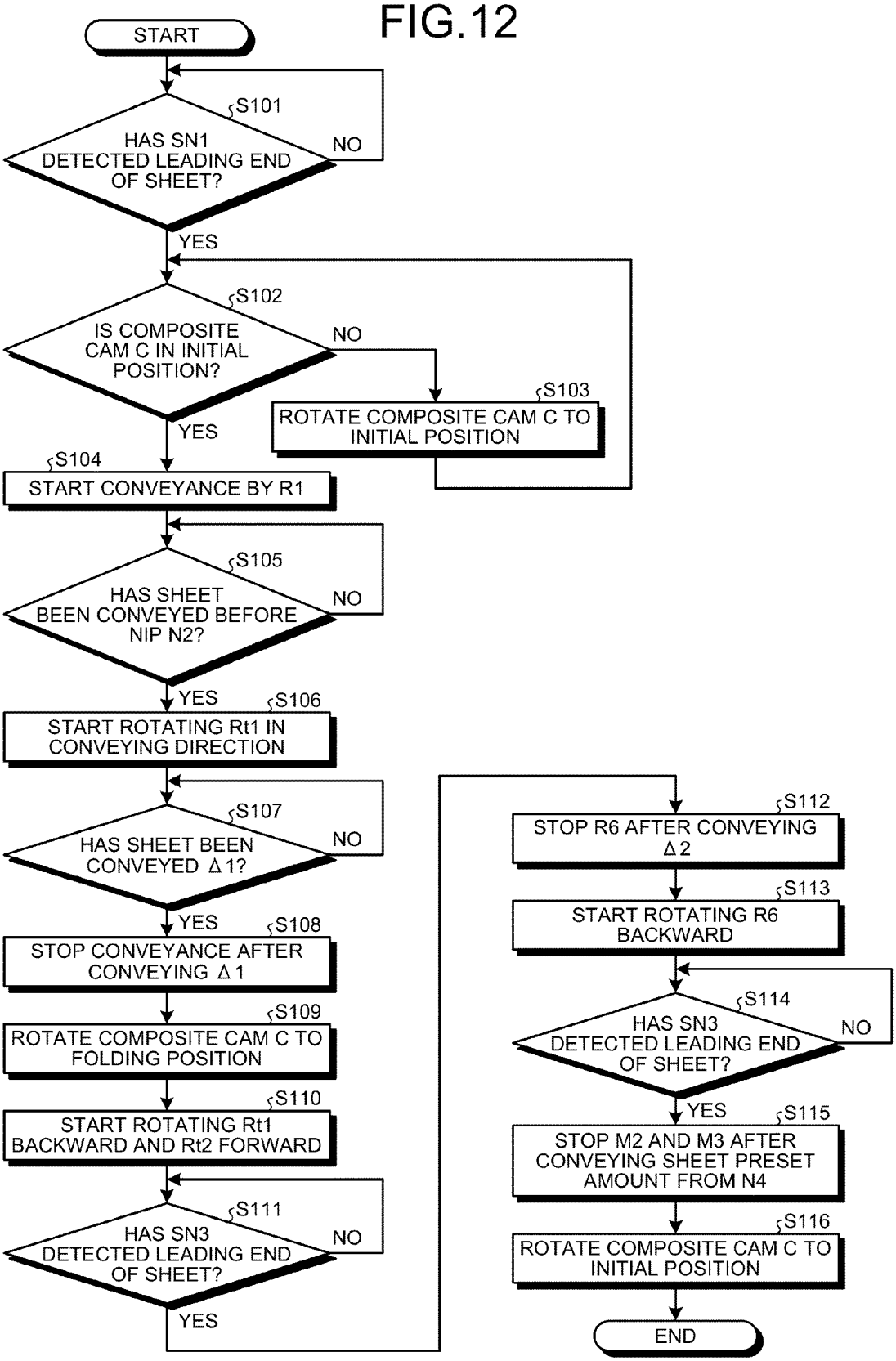
FIG. 12 is a flowchart of the steps of folding a sheet in z-fold illustrated in FIGS. 11A to 11H.

FIG. 11A illustrates a state immediately after the first sheet-detection sensor SN1 detects the sheet P conveyed from the image forming apparatus 200 to the first conveying path W1.

When the leading end P1 of the sheet P conveyed from the image forming apparatus 200 to the first conveying path W1 is detected by the first sheet-detection sensor SN1 (Step S101), whether or not the composite cam C is in its initial position is determined (Step S102). The initial position is the position where the composite cam C is stopped after the lapse of the predetermined period of time or after rotating for the predetermined number of pulses since the feeler FL is detected by the position detecting sensor SN4. If the composite cam C is not in its initial position, the fourth drive motor M4 is driven to rotate the composite cam C to the initial position (Step S103).

Figure 11B:
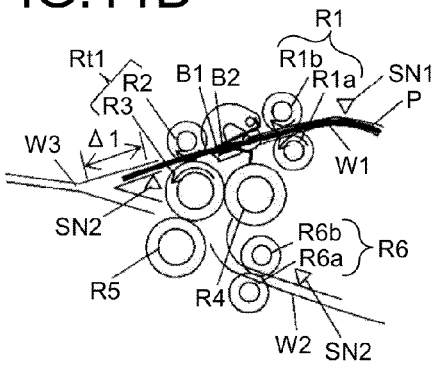

In the state where the composite cam C in its initial position, conveyance of the sheet P is started by the first drive motor M1 by rotating the first pair of conveying rollers R1 in the direction indicated by arrows in FIG. 11B (Step S104). When the leading end P1 of the sheet P has advanced into the first nip N1 between the first pair of conveying rollers R1, the sheet P is conveyed by the first pair of conveying rollers R1 to the downstream second pair of conveying rollers Rt1. At this time, the composite cam C remains in its initial position illustrated in FIGS. 6A to 6C, which is the same position as that for the pass-through conveyance.

When the sheet P conveyed through between the upper and lower bifurcating claws B1 and B2 reaches immediately before the nip between the second pair of conveying rollers Rt1 (Step S104), the second pair of conveying rollers Rt1 starts rotating in the direction (forward direction) of conveying the sheet P downstream in the sheet conveying direction (Step S106). When the leading end of the sheet P reaches the second nip N2 between the second pair of conveying rollers Rt1, the sheet P is pinched by the second nip N2 and conveyed further downstream.

At a point in time when the leading end P1 of the sheet P conveyed in this manner is detected by the second sheet-detection sensor SN2, the second drive motor M2 decelerates. The sheet P is then conveyed past the detection position of the second sheet-detection sensor SN2 a preset projection amount Δ1 for z-fold (FIG. 11B) (Step S107). When the sheet P reaches the position of the projection amount Δ1 or, in other words, when the position one-fourth of the total length from the leading end of the sheet P in the conveying direction reaches a position at which the sheet P is to be folded in the third nip N3 between the third pair of conveying rollers Rt2 on the connecting path W2*c*, the sheet P is temporarily stopped (Step S108).

Figure 11C:
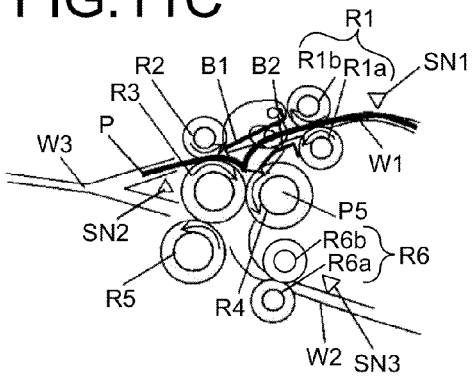

After the sheet P is stopped, the fourth drive motor M4 is driven to rotate the composite cam C from the initial position illustrated in FIGS. 6A to 6C to the folding position illustrated in FIGS. 7A to 7C (Step S109). In conjunction with the rotation of the composite cam C, the lower bifurcating claw B2 rotates downward to the position illustrated in FIG. 7B. The second drive motor M2 starts rotating backward to rotate the second pair of conveying rollers Rt1 backward, thereby conveying the sheet P upstream (backward) in the sheet conveying direction (FIG. 11C). At this time, the fourth conveying roller R4 which is in contact with the third conveying roller R3 is also rotated by rotation of the third conveying roller R3. Consequently, the third pair of conveying rollers Rt2 starts rotating in the direction of conveying the sheet P to the second conveying path W2 (Step S110). Meanwhile, the first pair of conveying rollers R1 stops rotating in synchronization with the second pair of conveying rollers Rt1 and thereafter conveys the sheet P at the same speed as the second pair of conveying rollers Rt1.

To be more specific, the second drive motor M2 is controlled so as to be stopped and then rotated backward after the sheet P has been conveyed past a detection position of the second sheet-detection sensor SN2 the preset projection amount Δ1, rather than immediately when the sheet P conveyed from upstream passes by the detection position. The projection amount Δ1 can be determined using a calculation result obtained as follows. In advance of start of a job (forming an image on the sheet P), the CPU 100*a* receives data about the length (hereinafter, "sheet length") of the sheet P in the conveying direction from the image forming apparatus 200 and automatically calculates a movement amount based on the data. Even without performing the calculation, the movement amount can be determined based on a sheet size using a table, in which relationship between the sheet size and the movement amount is tabulated, stored in a ROM in advance.

Figure 11D:
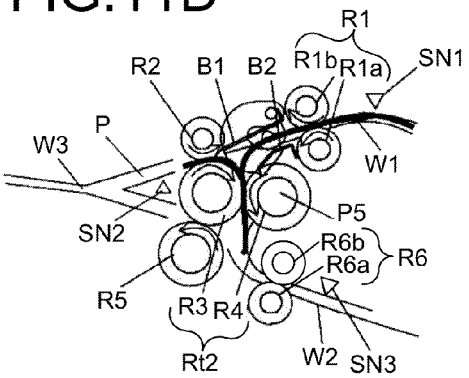

As the second drive motor M2 rotates backward, the sheet P is guided by the upper and lower bifurcating claws B1 and B2 and deflected at the connecting path W2*c* so as to project toward the third nip N3 between the third pair of conveying rollers Rt2 as illustrated in FIG. 11C. A vertex of the deflected portion P5 is pinched in the third nip N3, whereby a first crease P2 is formed as illustrated in FIG. 11D. Thereafter, the sheet P advances to the second conveying path W2 with the first crease P2 on a leading edge. Similar control can be provided by, rather than stopping the first pair of conveying rollers R1, causing the first pair of conveying rollers R1 to continue rotating in a sheet-output direction.

Figure 11E:
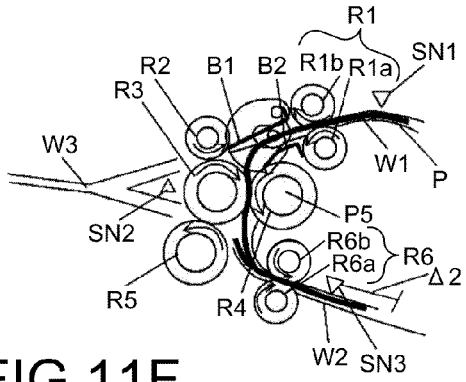

As illustrated in FIG. 11D, the first crease P2 of the sheet P formed in the third nip N3 is guided to the fifth pair of conveying rollers R6 along a downward slope of the second conveying path W2. Subsequently, as illustrated in FIG. 11E, the sheet P is pinched and conveyed by the fifth nip N5 of the fifth pair of conveying rollers R6 that has started rotating in the direction indicated by arrows in FIG. 11E. The leading end (the first crease P2) of the sheet P is detected by the third sheet-detection sensor SN3 (Step S111). The sheet P is then conveyed past the detection position a second projection amount Δ2. When the sheet P has been conveyed past the detection position the second projection amount Δ2, the third drive motor M3 and the fifth pair of conveying rollers R6 stop rotating (Step S112) and then start rotating backward (Step S113). The second projection amount Δ2 can alternatively be set as a projection amount with reference to the fifth nip N5.

As in the case of the first projection amount Δ1, the second projection amount Δ2 is determined based on the sheet length and the fold type; and the determination is made based on a rotation amount (the number of steps the third drive motor M3 is driven) of the fifth pair of conveying rollers R6. The fifth pair of conveying rollers R6 is rotated backward in a state in which the third pair of conveying rollers Rt2 is rotating in the direction illustrated in FIGS. 11C to 11E. As a result, the sheet P is deflected at the connecting path W2*c* and downstream of the third nip N3 as illustrated in FIG. 11F.

Figure 11F:
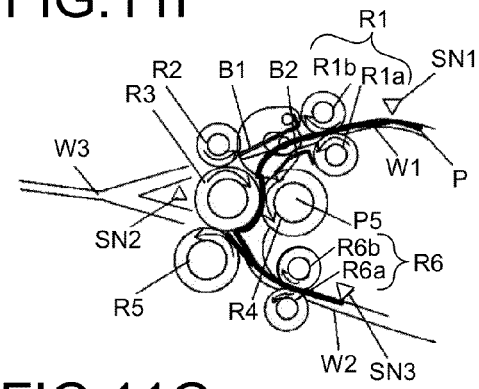
Figure 11G:
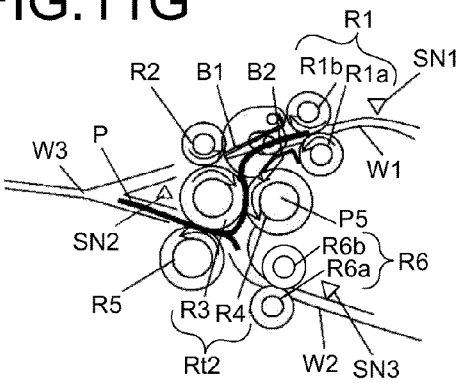
Figure 11H:
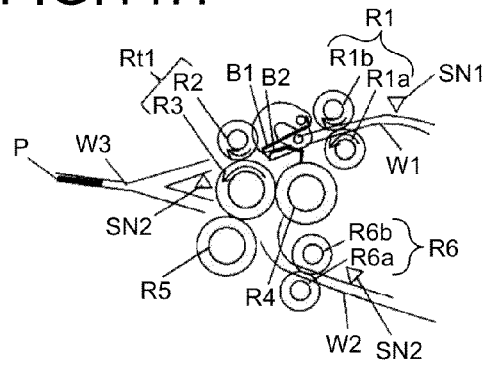

Keeping the third pair of conveying rollers Rt2 rotating in the direction indicated by arrows in FIG. 11F causes the deflected portion to advance into the fourth nip N4 between the fourth pair of conveying rollers Rt3. The sheet P is then conveyed to the third conveying path W3 as illustrated in FIG. 11G. During this conveyance, the second folding is applied to form a second crease P3 in the sheet P. The sheet P, to which the second folding is applied, is delivered to the third conveying path W3 by the fourth pair of conveying rollers Rt3. As illustrated in FIG. 11H, the sheet P is conveyed by a pair of sheet output rollers (not shown) arranged on the third conveying path W3 to the downstream post-processing apparatus 300 or discharged onto the sheet output tray 400.

Referring to FIG. 11F, more specifically, the third sheet-detection sensor SN3 detects passage of a trailing end of the sheet P (Step S114). The second and third drive motors M2 and M3 stop driving after the sheet P has passed through the fourth nip N4 (Step S115). As a result, the second through fifth pairs of conveying rollers Rt1, Rt2, Rt3, and Rt4 stop rotating. As illustrated in FIG. 11F, the first drive motor M1 stops rotating after the trailing end of the sheet P has exited the first nip N1, timing of which depends on when the first sheet-detection sensor SN1 has detected the trailing end of the sheet P. Thereafter, the fourth drive motor M4 is further driven to bring back the composite cam C to its initial position for a next job (Step S116).

FIGS. 13A to 13H are diagrams illustrating how the sheet P is folded in letter fold-in. FIGS. 14A to 14H are diagrams illustrating how the sheet P is folded in letter fold-out.

Because each element operates as in z-fold, like reference designators refer to like elements, for which reason repeated description is dispensed with below. It should be noted that each of the first projection amount Δ1 and the second projection amount Δ2, and when the second pair of conveying rollers Rt1 and the fifth pair of conveying rollers R6 should start rotating backward varies depending on the sheet length and the fold type. FIG. 16B is a diagram of the sheet P folded in letter-fold in. FIG. 16C is a diagram of the sheet P folded in letter-fold out. Referring to FIGS. 16A to 16C, the creases P2 and P3 of z-fold, creases P4 and P5 of letter-fold in, and creases P6 and P7 of letter-fold out vary from each other in position and folding direction.

Figure 13A:
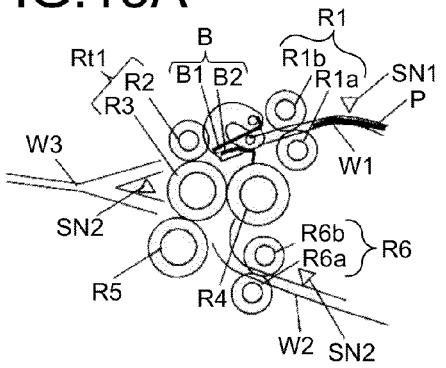
Figure 13B:
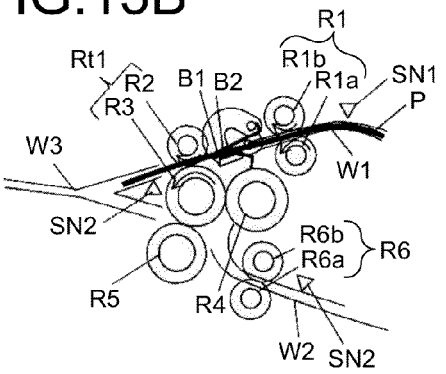
Figure 13C:
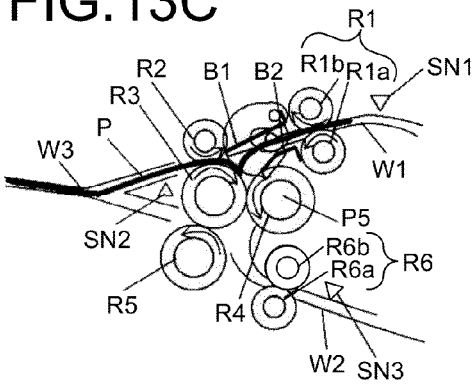
Figure 13D:
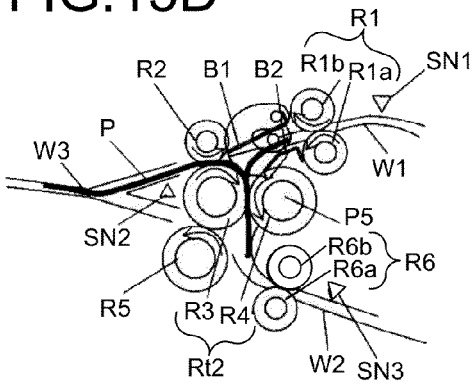
Figure 13E:
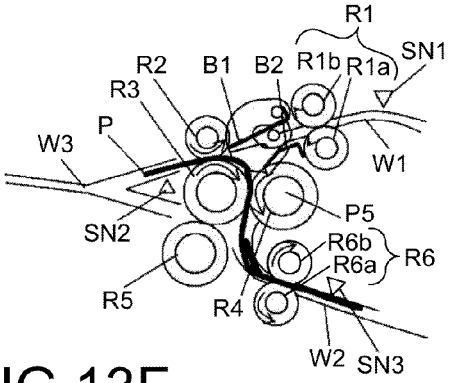
Figure 13F:
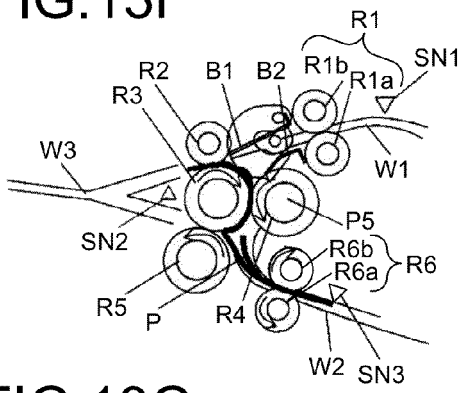
Figure 13G:
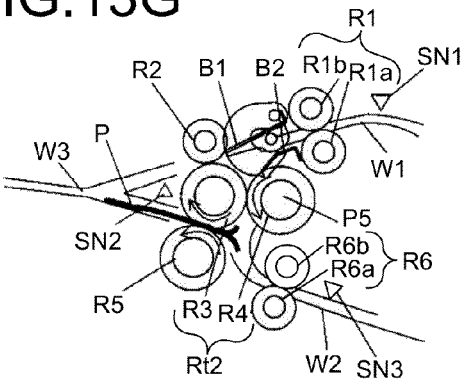
Figure 13H:
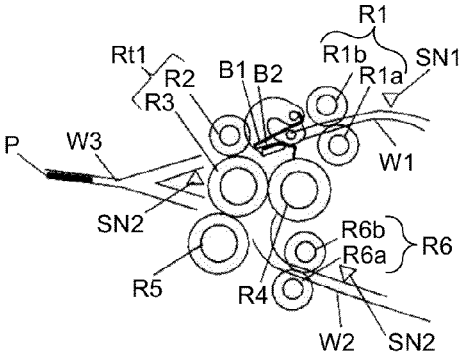

In letter-fold in, the first crease P4 is at a position two-thirds of the total length of the sheet P from the leading end P1 in the sheet conveying direction (FIG. 16B); the first projection amount Δ1 is determined according to this folding position. After the projection by the first projection amount Δ1 is achieved, the second pair of conveying rollers Rt1 rotates backward (FIG. 13C). The second crease P5 is at a position one-thirds of the total length from the sheet leading end P1 (FIG. 16B). The second projection amount Δ2 is determined according to this folding position. As in the case of the first folding, after the projection by the second projection amount Δ2 is achieved, the fifth pair of conveying rollers R63 rotates backward (FIG. 11F).

Figure 14A:
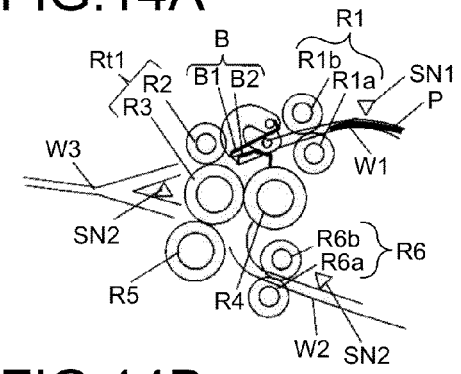
FIGS. 14A to 14H are diagrams illustrating how a sheet is folded in letter fold-out.
Figure 14B:
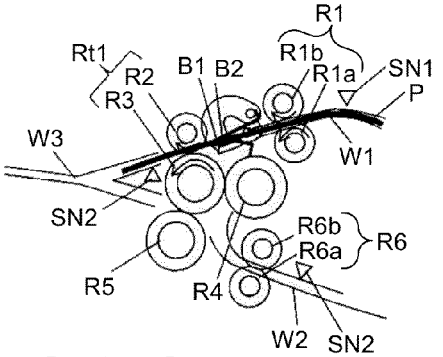
Figure 14C:
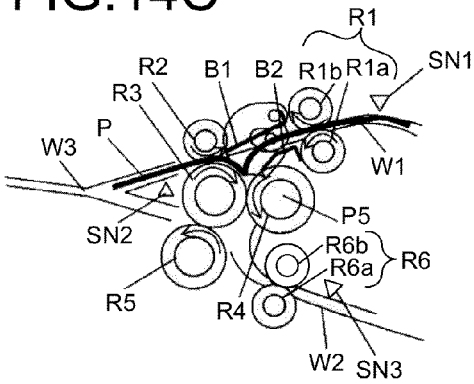
Figure 14D:
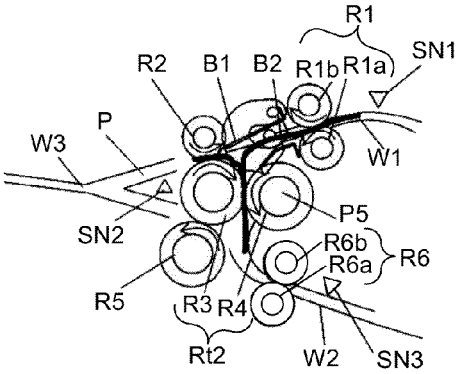
Figure 14E:
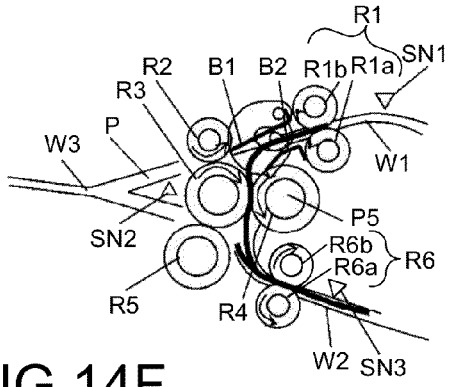
Figure 14F:
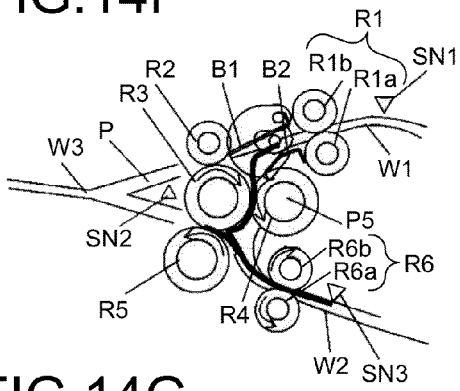
Figure 14G:
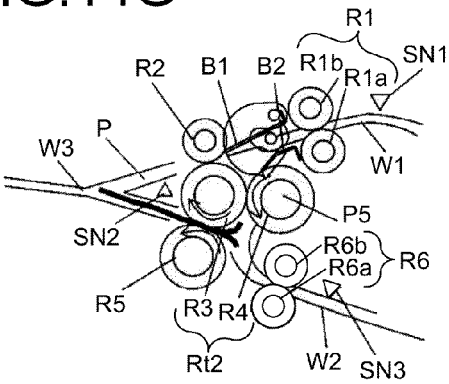
Figure 14H:
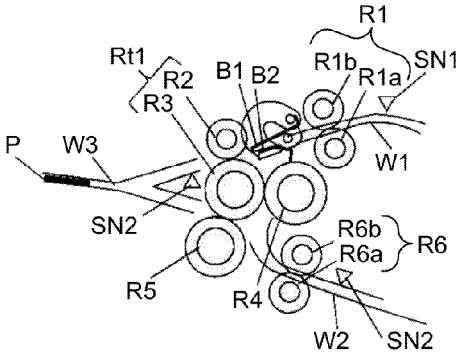

By contrast, in letter-fold out, the first crease P6 is at a position one-thirds of the total length of the sheet P from the leading end P1 in the sheet conveying direction (FIG. 16C); the first projection amount Δ1 is determined according to this folding position. After conveying the sheet P past the detection position of the second sheet-detection sensor SN2 the first projection amount Δ1, the second pair of conveying rollers Rt1 rotates backward (FIG. 14C). The second crease P7 is at a position two-thirds of the total length from the sheet leading end P1 (FIG. 16C); the second projection amount Δ2 is determined according to this folding position. As in the case of the first folding, after conveying the sheet P past the detection position of the third sheet-detection sensor SN3 the second projection amount Δ2, the fifth pair of conveying rollers R6 rotates backward (FIG. 14F).

FIGS. 15A to 15G are diagrams illustrating how a sheet is folded in half-fold. Also in half-fold, when the leading end P1 of the sheet P conveyed from the image forming apparatus 200 to the first conveying path W1 is detected by the first sheet-detection sensor SN1 (FIG. 15A), whether or not the upper and lower bifurcating claws B1 and B2 are in the half-fold position illustrated in FIGS. 8A to 8C is determined. If the upper and lower bifurcating claws B1 and B2 are not in the half-fold position, the composite cam C is rotated from, for example, its initial position to its half-fold position, thereby placing the upper and lower bifurcating claws B1 and B2 in the half-fold position. In the state in which the upper and lower bifurcating claws B1 and B2 are in the half-fold position, the first drive motor M1, the second drive motor M2, and the third drive motor M3 are driven to start conveyance by the first pair of conveying rollers R1.

More specifically, the second drive motor M2 starts rotating in the direction which conveys the sheet P in the direction opposite to the conveying direction toward the third conveying path W3. Similarly, the third drive motor M3 starts rotating in the direction opposite to the direction toward the third conveying path W3. The sheet P conveyed by the first pair of conveying rollers R1 is guided by the upper and lower bifurcating claws B1 and B2 to the third nip N3 between the third pair of conveying rollers Rt2 (Step S11(*b*)). The sheet P guided to the third nip N3 is guided to the fifth pair of conveying rollers R6 along the downward slope of the second conveying path W2, and pinched and conveyed by the fifth nip N5 between the fifth pair of conveying rollers R6 that has started rotating in the direction indicated by arrows in FIG. 15C. The leading end of the sheet P is detected by the third sheet-detection sensor SN3. The sheet P is then conveyed past the detection position of the third sheet-detection sensor SN3 a projection amount, which depends on a folding position for half-fold. When the sheet P has been conveyed past the detected position the projection amount, the third drive motor M3 and the fifth pair of conveying rollers R6 stop rotating and then start rotating backward. The projection amount can alternatively be set as a projection amount with reference to the fifth nip N5.

As in the case of the first projection amount Δ1 in z-fold, the projection amount in half-fold is determined based on the sheet length and the fold type; and the determination is made based on a rotation amount (the number of steps the third drive motor M3 is driven) of the fifth pair of conveying rollers R6. The fifth pair of conveying rollers R6 is rotated backward in a state in which the third pair of conveying rollers Rt2 is rotating in the direction illustrated in FIGS. 15B and 15C. As a result, the sheet P is deflected at the connecting path W2*c* and downstream of the third nip N3 as illustrated in FIG. 15D.

Figure 15A:
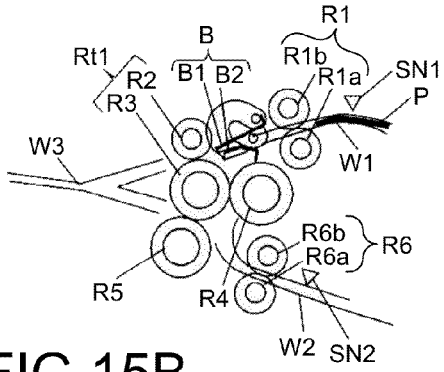
FIGS. 15A to 15G are diagrams illustrating how a sheet is folded in half-fold.
Figure 15B:
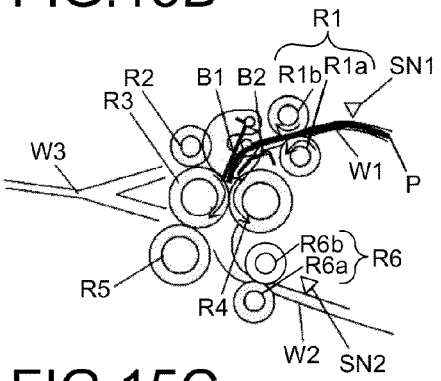
Figure 15C:
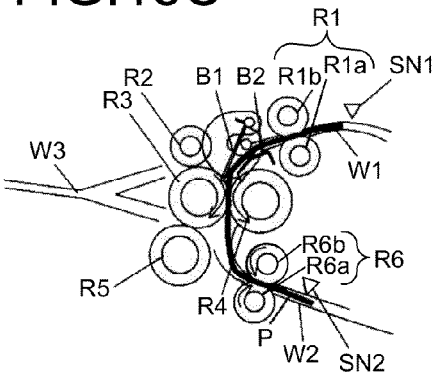
Figure 15D:
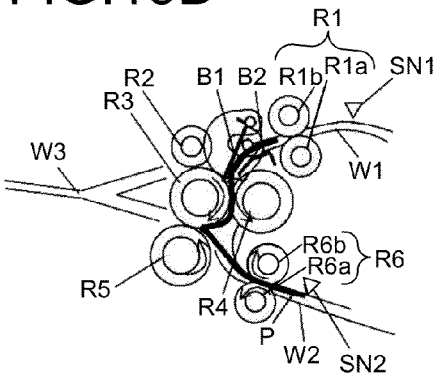
Figure 15E:
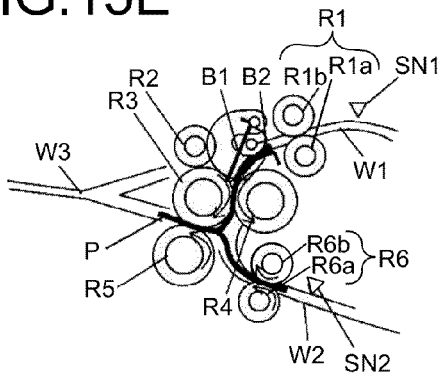
Figure 15F:
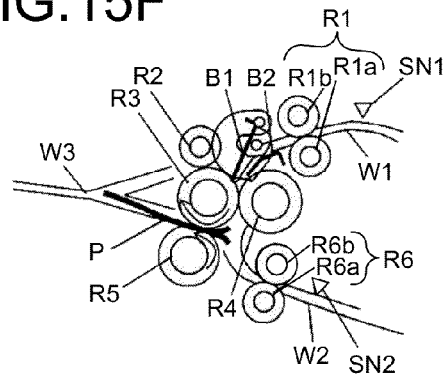
Figure 15G:
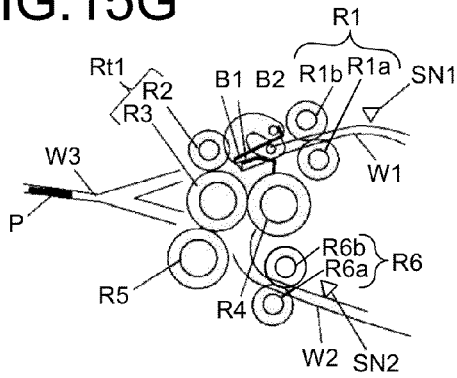

Keeping the third pair of conveying rollers Rt2 rotating in the direction indicated by arrows in FIG. 15D causes a deflected portion to advance into the fourth nip N4 between the fourth pair of conveying rollers Rt3. Consequently, the sheet P is conveyed to the third conveying path W3 as illustrated in FIG. 15E. During this conveyance, the sheet P is folded in half-fold and a crease is formed in the sheet P. The sheet P folded in half-fold as illustrated in FIG. 15F is further delivered to the third conveying path W3 by the fourth pair of conveying rollers Rt3. As illustrated in FIG. 15G, the sheet P is conveyed by the pair of sheet output rollers (not shown) arranged on the third conveying path W3 to the downstream post-processing apparatus 300 or discharged onto the sheet output tray 400. Simultaneously, the composite cam C is rotated to its initial position to thereby move the upper and lower bifurcating claws B1 and B2 to their initial positions to wait for a next folding instruction.

When the apparatus employs a configuration in which the upstream end of the second conveying path W2 is connected to the upstream end of the first conveying path W1, the apparatus can perform half-fold through another procedure. This procedure is performed in a manner similar to that of the z-fold illustrated in FIGS. 11A to 11H except that the first crease P2 is formed at a center of the sheet P or a position where the sheet P is to be folded in half. The second pair of conveying rollers Rt1 is rotated backward as described above with reference to FIGS. 11B and 11C. Thereafter, steps are performed as illustrated FIGS. 11D and 11E. After the sheet P has been folded as illustrated in FIG. 11E, the sheet P is conveyed upstream along the second conveying path W2 without rotating the fifth pair of conveying rollers R6 backward, thereby bringing the sheet P back from the second conveying path W2 to the first conveying path W1. Thereafter, the sheet P is caused pass through the first conveying path W1 and delivered to the third conveying path W3 as in the steps illustrated in FIGS. 10A to 10C.

This procedure differs from the procedure illustrated in FIGS. 15A to 15G in a folding direction with respect to a printed face of the sheet. Accordingly, selection therebetween can be made according to the relation to the printed face.

The folding mechanism illustrated in FIG. 3 can fold the sheet P in any one of half-fold, z-fold, letter fold-in, and letter fold-out as described above.

Meanwhile, an undesirable situation can occur in such an apparatus as that of this embodiment that performs folding at the connecting path W2*c* between the first conveying path W1 and the second conveying path W2. More specifically, in a case where the sheet P conveyed from the first conveying path W1 should be curled, the sheet leading end P1 can undesirably be caught in a small clearance between a terminal end of the first conveying path W1 and the upper bifurcating claw B1. A similar undesirable situation can occur in a clearance between a terminal end of the lower bifurcating claw B2 and the third conveying roller R4.

Figure 17A:
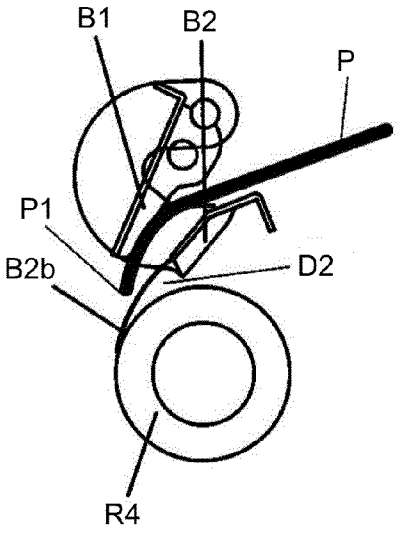
FIGS. 17A and 17B are diagram each describing a configuration for preventing entry of a leading end of a sheet to an unintended position by providing an elastic member at around the bifurcating claws.
Figure 17B:
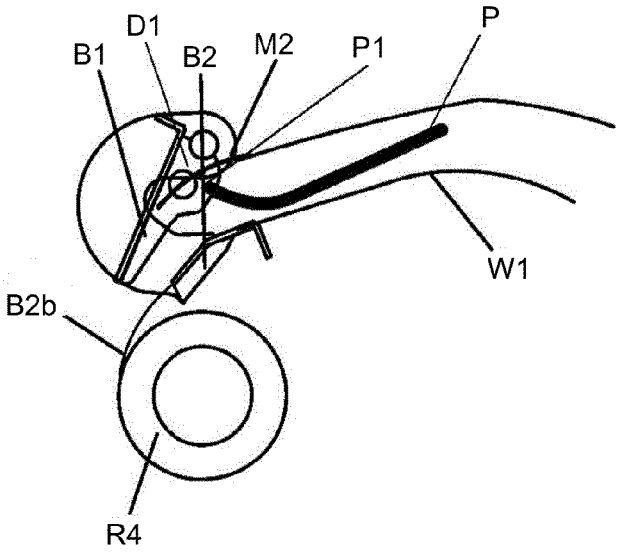

FIGS. 17A and 17B are diagrams each illustrating a configuration for preventing occurrence of such an undesirable situation. In this embodiment, to prevent unintended entry into such a clearance as that described above, a plate-like first elastic member B1*b* which covers a terminal end portion of the first conveying path W1 from above is added (FIG. 17B). Similarly, a second elastic member B2*b* is added at the terminal end of the lower bifurcating claw B2 (FIG. 17A). The first elastic member B1*b* is a plate-like member extending from the terminal end of the first conveying path W1 to a middle portion of the upper bifurcating claw B1. Adding the first elastic member Bib in this manner prevents the sheet P, which is upwardly curled at the leading end P1, from entering into a clearance D1 between the terminal end of the first conveying path W1 and the upper bifurcating claw B1 as illustrated in FIG. 17B.

The second elastic member B2*b* is a plate member extending from the end of the lower bifurcating claw B2 to a surface of the third conveying roller R4 immediately upstream of the third nip N3 of the third pair of conveying rollers Rt2. Adding the second elastic member B2*b* in this manner prevents the sheet P, which is downwardly curled at the leading end P1, from entering into a clearance D2 between the downstream end of the lower bifurcating claw B2 and the third conveying roller R4 as illustrated in FIG. 17A.

Adding the first and second elastic members B1*b* and B2*b* in this manner makes it possible to convey the sheet P properly without paper jam even if the leading end P1 of the sheet P conveyed from the image forming apparatus 200 is curled. As a result, possibility of occurrence of conveyance failure can be reduced.

As described above, according to this embodiment, the following advantages can be obtained. In the following description about the advantages, each element in the embodiment is accompanied by an indication of a corresponding element in the appended claims or a corresponding reference designator in parenthesis to define relationship therebetween.

1) The sheet processing apparatus includes: the first pair of conveying rollers R1 (first pair of conveying members) and the third pair of conveying rollers Rt2 (third pair of conveying members) that convey the sheet P; the second pair of conveying rollers Rt1 (second pair of conveying members) that receives the sheet P conveyed by the first pair of conveying rollers R1 (first pair of conveying members) and conveys the sheet P downstream; and the bifurcating claws B that moves to the first guiding position (the position illustrated in FIGS. 6A to 6C) for guiding the sheet P to the second pair of conveying rollers Rt1 (second pair of conveying members), the second guiding position (the position illustrated in FIGS. 7A to 7C) for guiding the deflected portion P5 of the sheet P to the third pair of conveying rollers Rt2 (third pair of conveying members), and the third guiding position (the position illustrated in FIGS. 8A to 8C) for guiding the sheet P to the third pair of conveying rollers Rt2 (third pair of conveying members). The second pair of conveying rollers Rt1 (second pair of conveying members) is rotated backward in a state in which the sheet P is held by the first pair of conveying rollers R1 (first pair of conveying members) and the second pair of conveying rollers Rt1 (second pair of conveying members) to guide the deflected portion to the third pair of conveying rollers Rt2 (third pair of conveying members) and cause the deflected portion to be folded by the third pair of conveying rollers Rt2 (third pair of conveying members). Accordingly, the bifurcating claws B can provide the following functions in the specific space (i.e., the connecting path W2*c* where the bifurcating claws B is located): conveying the sheet P to a downstream apparatus; guiding the deflected portion P5, which is formed in the folding process, to the pair of folding rollers; and guiding the sheet leading end to the folding unit. Thus, according to this embodiment, because the sheet processing apparatus includes the bifurcating claws B capable of taking any one the three forms (guiding positions), both changing a route of the sheet leading end P1 and guiding the deflected portion, which is formed in the folding process, can be performed in the single space (the connecting path W2*c*). As a result, downsizing of a sheet processing apparatus capable of folding a sheet using rollers can be achieved.

2) The sheet processing apparatus further includes the single drive motor M (drive source) which moves the bifurcating claws B to the first through third guiding positions. Accordingly, the bifurcating claws B can be moved to any one of the three guiding positions easily only by rotating (driving) the single drive motor M.

3) The bifurcating claws B include the upper bifurcating claw B1 and the lower bifurcating claw B2 that vary the relative position to each other. The sheet P passes through between the upper bifurcating claw B1 and the lower bifurcating claw B2. Accordingly, it is possible to guide and convey the sheet P corresponding to the three functions based on the relative position between the upper bifurcating claw B1 and the lower bifurcating claw B2.

4) The sheet processing apparatus further includes the composite cam C (cam unit) which sets the relative position between the upper bifurcating claw B1 and the lower bifurcating claw B2. Accordingly, the setting to the first through third guiding positions can be easily performed only by rotating the composite cam C using the single drive motor M.

5) The composite cam C (cam unit) includes the first cam part C1 and the second cam part C2 which coaxially rotate and have different shapes. The upper bifurcating claw B1 and the lower bifurcating claw B2 are moved to one of the first through third guiding positions by the first cam part C1 and the second cam part C2. Accordingly, the bifurcating claws B can be moved to any one of the three guiding positions easily by shaping the first cam part C1 and the second cam part C2 in accordance with the guiding positions.

6) The sheet processing apparatus further includes: the first cam follower CF1 which is in contact with the first cam part C1 and swings in accordance with rotation of the first cam part C1; and the second cam follower CF2 which is in contact with the second cam part C2 and swings in accordance with rotation of the second cam part C2. The revolving shaft B1*a* of the upper bifurcating claw B1 is coaxially connected with the first cam follower CF1 and they integrally rotate. The revolving shaft B2*a* of the lower bifurcating claw B2 is coaxially connected with the second cam follower CF2 and they integrally rotate. Accordingly, it is possible to move the upper bifurcating claw B1 and the lower bifurcating claw B2 accurately to positions which are respectively determined by the first cam part C1 and the second cam part C2.

7) The sheet processing apparatus further includes the first elastic member B1*b* arranged at the first conveying path W1 (conveying path) and upstream of the bifurcating claw B so as to close the clearance D1 between the first conveying path W1 (conveying path) and the upper bifurcating claw B1. Accordingly, conveyance failure such as paper jam can be prevented because entry of the sheet leading end P1 to the clearance D1 can be prevented.

8) The sheet processing apparatus further includes the second elastic member B2*b* arranged at the end portion of the lower bifurcating claw B2 closer to the third pair of conveying members Rt2 (third pair of conveying members) so as to close the clearance D2 between the end portion of the lower bifurcating claw B2 and the third pair of conveying members Rt2 (third pair of conveying members). Accordingly, conveyance failure such as paper jam can be prevented because entry of the sheet leading end P1 to the clearance D2 can be prevented.

9) The image forming system 1 includes the folding apparatus 100 (sheet processing apparatus) and the image forming apparatus 200. Accordingly, the image forming system 1 can provide the advantages 1) through 8) described above.

According to an embodiment, downsizing of a sheet processing apparatus capable of folding a sheet using rollers can be achieved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus comprising:

a first pair of conveying members and a third pair of conveying members that convey a sheet;

a second pair of conveying members that receives the sheet conveyed by the first pair of conveying members and conveys the sheet downstream;

a bifurcating claw that moves to a first guiding position for guiding the sheet to the second pair of conveying members, a second guiding position for guiding a deflected portion of the sheet to the third pair of conveying members, and a third guiding position for guiding a leading end of the sheet to the third pair of conveying members, wherein the second pair of conveying members is rotated backward in a state in which the sheet is held by the first pair of conveying members and the second pair of conveying members, to guide the deflected portion to the third pair of conveying members and cause the deflected portion to be folded by the third pair of conveying members, wherein the bifurcating claw includes an upper bifurcating claw and a lower bifurcating claw that vary a relative position to each other, and the sheet passes through between the upper bifurcating claw and the lower bifurcating claw; and a cam unit which sets the relative position between the upper bifurcating claw and the lower bifurcating claw.

2. The sheet processing apparatus according to claim 1, further comprising a single drive source that moves the bifurcating claw to the first through third guiding positions.

3. The sheet processing apparatus according to claim 1, wherein the cam unit includes a first cam part and a second cam part that coaxially rotate and have different shapes, and the upper bifurcating claw and the lower bifurcating claw are moved to the first through third guiding positions by the first cam part and the second cam part.

4. The sheet processing apparatus according to claim 3, further comprising:

a first cam follower that is in contact with the first cam part and swings in accordance with rotation of the first cam part; and a second cam follower that is in contact with the second cam part and swings in accordance with rotation of the second cam part, wherein the upper bifurcating claw and the first cam follower are coaxially connected and integrally rotate, and the lower bifurcating claw and the second cam follower are coaxially connected and integrally rotate.

5. The sheet processing apparatus according to claim 1, further comprising a first elastic member arranged at a conveying path and upstream of the bifurcating claw so as to close a clearance between the conveying path and the upper bifurcating claw.

6. The sheet processing apparatus according to claim 1, further comprising a second elastic member arranged at an end portion of the lower bifurcating claw closer to the third pair of conveying members so as to close a clearance between the end portion of the lower bifurcating claw and the third pair of conveying members.

7. An image forming system comprising a sheet processing apparatus, wherein the sheet processing apparatus comprising:

a first pair of conveying members and a third pair of conveying members that convey a sheet;

a second pair of conveying members that receives the sheet conveyed by the first pair of conveying members and conveys the sheet downstream;

a bifurcating claw that moves to a first guiding position for guiding the sheet to the second pair of conveying members, a second guiding position for guiding a deflected portion of the sheet to the third pair of conveying members, and a third guiding position for guiding a leading end of the sheet to the third pair of conveying members, and the second pair of conveying members is rotated backward in a state in which the sheet is held by the first pair of conveying members and the second pair of conveying members, to guide the deflected portion to the third pair of conveying members and cause the deflected portion to be folded by the third pair of conveying members, wherein the bifurcating claw includes an upper bifurcating claw and a lower bifurcating claw that vary a relative position to each other, and the sheet passes through between the upper bifurcating claw and the lower bifurcating claw; and a cam unit which sets the relative position between the upper bifurcating claw and the lower bifurcating claw.

8. A sheet conveying method for a sheet processing apparatus including:

a first pair of conveying members and a third pair of conveying members that convey a sheet, a second pair of conveying members that receives the sheet conveyed by the first pair of conveying members and conveys the sheet downstream, and a bifurcating claw that moves to a first guiding position for guiding the sheet to the second pair of conveying members, a second guiding position for guiding a deflected portion of the sheet to the third pair of conveying members, and a third guiding position for guiding a leading end of the sheet to the third pair of conveying members, the sheet conveying method comprising:

if the sheet conveyed by the first pair of conveying members is to be directly conveyed to a downstream apparatus, bringing the bifurcating claw to the first guiding position for guiding the sheet to the second pair of conveying members;

if the sheet is to be folded by the third pair of conveying members, bringing the bifurcating claw to the second guiding position for guiding the deflected portion of the sheet to the third pair of conveying members;

if the sheet is to be folded by the third pair of conveying members or is to be folded at a position downstream of the third pair of conveying members, bringing the bifurcating claw to the third guiding position for guiding the sheet to the third pair of conveying members and conveying the sheet; and if the sheet is to be folded by the third pair of conveying members, rotating the second pair of conveying members backward in a state in which the sheet is held by the first pair of conveying members and the second pair of conveying members to guide the deflected portion toward the third pair of conveying members and cause the deflected portion to be folded by the third pair of conveying members.

* * * * *